US007215297B2

(12) United States Patent
Gothard et al.

(10) Patent No.: US 7,215,297 B2
(45) Date of Patent: May 8, 2007

(54) ADAPTIVE ANTENNA FOR USE IN WIRELESS COMMUNICATION SYSTEMS

(75) Inventors: Griffin K. Gothard, Satellite Beach, FL (US); Alton S. Keel, Jr., Melbourne, FL (US); Christopher A. Snyder, Melbourne, FL (US); Bing Chiang, Melbourne, FL (US); Joe T. Richeson, Melbourne, FL (US); Douglas H. Wood, Palm Bay, FL (US); James A. Proctor, Jr., Melbourne Beach, FL (US); Kenneth M. Gainey, Satellite Beach, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

(21) Appl. No.: 11/332,901

(22) Filed: Jan. 17, 2006
(Under 37 CFR 1.47)

(65) Prior Publication Data

US 2006/0125709 A1 Jun. 15, 2006

Related U.S. Application Data

(60) Division of application No. 10/744,912, filed on Dec. 23, 2003, now Pat. No. 6,989,797, which is a continuation-in-part of application No. 10/441,977, filed on May 20, 2003, now abandoned, which is a division of application No. 09/859,001, filed on May 16, 2001, now Pat. No. 6,600,456, and a continuation-in-part of application No. 09/579,084, filed on May 25, 2000, now Pat. No. 6,304,215, which is a division of application No. 09/210,117, filed on Dec. 11, 1998, now Pat. No. 6,100,843, which is a continuation of application No. 09/157,736, filed on Sep. 21, 1998, now abandoned.

(60) Provisional application No. 60/234,485, filed on Sep. 22, 2000.

(51) Int. Cl.
*H01Q 19/10* (2006.01)

(52) U.S. Cl. ..... 343/834; 343/840; 342/367

(58) Field of Classification Search ..... 343/834, 343/833, 835–840; 342/367, 368
See application file for complete search history.

(56) References Cited

U.S. PATENT DOCUMENTS 3,560,978 A 2/1971 Himmel et al.

(Continued)

OTHER PUBLICATIONS

Ohira and Gyoda, "Electronically Steerable Passive Array Radiator Antennas for Low-Cost Analog Adaptive Beamforming,"0-7803-6345-0/00, 2000 IEEE.

(Continued)

*Primary Examiner*—Trinh Dinh
*Assistant Examiner*—Huedung Mancuso
(74) *Attorney, Agent, or Firm*—Volpe and Koenig, P.C.

(57) ABSTRACT

An antenna apparatus, which can increase capacity in a cellular communication system or Wireless Local Area Network (WLAN), such as an 802.11 network, operates in conjunction with a mobile subscriber unit or client station. At least one antenna element is active and located within multiple passive antenna elements. The passive antenna elements are coupled to selectable impedance components for phase control of re-radiated RF signals. Various techniques for determining the phase of each antenna element are supported to enable the antenna apparatus to direct an antenna beam pattern toward a base station or access point with maximum gain, and, consequently, maximum signal-to-noise ratio. By directionally receiving and transmitting signals, multipath fading is greatly reduced as well as intercell interference.

28 Claims, 20 Drawing Sheets

U.S. PATENT DOCUMENTS

| | | | | |
|---|---|---|---|---|
| 3,725,938 | A | 4/1973 | Black et al. | |
| 3,846,799 | A | 11/1974 | Guegen | |
| 3,950,753 | A | 4/1976 | Chisholm | |
| 4,021,813 | A | 5/1977 | Black et al. | |
| 4,099,184 | A | 7/1978 | Rapshys | |
| 4,260,994 | A | 4/1981 | Parker | |
| 4,290,071 | A | 9/1981 | Fenwick | |
| 4,387,378 | A | 6/1983 | Henderson | |
| 4,631,546 | A | 12/1986 | Dumas et al. | |
| 4,700,197 | A | 10/1987 | Milne | |
| 5,027,125 | A * | 6/1991 | Tang | 342/368 |
| 5,235,343 | A | 8/1993 | Audren et al. | |
| 5,293,172 | A | 3/1994 | Lamberty et al. | |
| 5,294,939 | A | 3/1994 | Sanford et al. | |
| 5,617,102 | A | 4/1997 | Prater | |
| 5,767,807 | A | 6/1998 | Pritchett | |
| 5,905,473 | A * | 5/1999 | Taenzer | 343/834 |
| 6,034,638 | A | 3/2000 | Thiel et al. | |
| 6,100,843 | A * | 8/2000 | Proctor et al. | 342/368 |
| 6,317,092 | B1 | 11/2001 | de Schweinitz et al. | |
| 6,337,668 | B1 * | 1/2002 | Ito et al. | 343/833 |
| 6,515,635 | B2 | 2/2003 | Chiang et al. | |
| 2006/0022890 | A1 * | 2/2006 | Chiang et al. | 343/833 |

OTHER PUBLICATIONS

Scott, et al., "Diversity Gain from a Single-Port Adaptive Antenna Using Switched Parasitic Elements Illustrated with a Wire and Monopole Prototype," IEEE Transactions on Antennas and Propagation, vol. 47, No. 6, Jun. 1999.

King, Ronold W.P., *The Theory of Linear Antennas*, pp. 635-637, Harvard University Press, Cambridge, Mass., 1956.

Chelouah, A., et al. "Angular Diversity Based on Beam Switching of Circular Arrays for HIPERLAN Terminals," *Electonics Letters*, vol. 36, No. 5, Mar. 2, 2000, pp. 387-388.

Durnan,G.J., et al., "Switched Parasitic Feeds for Parabolic Antenna Angle Diversity," *Microwave and Optical Tech. Letters*, vol. 23, No. 4, Nov. 20, 1999, pp. 200-203.

Durnan, G.J.,et al., "Optimization of Microwave Parabolic Antenna Systems Using Switched Parasitic Feed Structures," URSI National Science Meeting, Boulder, CO, Jan. 4-8, 2000, p. 323.

Giger, A.J., *Low-Angle Microwave Propagation: Physics and Modeling*, Norwood, MA: Artech House, 1991.

Harrington, R.F., "Reactively Controlled Antenna Arrays," *IEEE APS International Symposium Digest*, Amherst, MA Oct. 1976, pp. 62-65.

Harrington, R. F. "Reactively Controlled Directive Arrays," *IEEE Trans. Antennas and Propagation*, vol. AP-26, No. 3, May 1978, pp. 390-395.

James, J.R. et al., "Electrically Short Monopole Antennas with Dielectric or Ferrite Coatings," *Proc. IEEE*, vol. 125, Sep. 1978, pp. 793-803.

James, J.R.,et al., "Reduction of Antenna Dimensions with Dielectric Loading," *Electronics Letters*, vol. 10, No. 13, May 1974, pp. 263-265.

King, R.W.P., "The Many Faces of the Insulated Antenna," *Proc. IEEE*, vol. 64, No. 2, Feb. 1976, pp. 228-238.

Kingsley, S.P., et al., "Beam Steering and Monopulse Processing of Probe-Fed Dielectric Resonator Antennas," *IEEE Proc.-Radar, Sonar Navig.*, vol. 146, No. 3, Jun. 1999, pp. 121-125.

Knight, P., "Low-Frequency Behaviour of the Beverage Aerial," *Electronics Letters*, vol. 13, No. 1, Jan. 1977, pp. 21-22.

Long, S. A., et al., "The Resonant Cylindrical Dielectric Cavity Antenna," *IEEE Trans. Antennas and Propagation*, vol. AP-31, No. 3, May 1983, pp. 406-412.

Lu, J.,et al.,Multi-beam Switched Parasitic Antenna Embedded in Dielectric for Wireless Communications Systems, *Electronics Letters*, vol. 37, No. 14, Jul. 5, 2001, pp. 871-872.

Luzwick, J., et al., "A Reactively Loaded Aperture Antenna Array," *IEEE Trans. Antennas and Propagation*, vol. AP-26, No. 4, Jul. 1978, pp. 543-547.

Milne, R.M.T., "A Small Adaptive Array Antenna for Mobile Communications," *IEEE APS International Symposium Digest*, 1985, pp. 797-800.

McAllister, M.W. et al., "Resonant Hemispherical Dielectric Antenna," *Electronics Letters*, vol. 20, No. 16, Aug. 1984, pp. 657-659.

McAllister, M.E. et al., "Rectangular Dielectric Resonator Antenna," *Electronics Letters*, vol. 19, No. 6, Mar. 1983, pp. 218-219.

Preston, S., et al., "Direction Finding Using a Switched Parasitic Antenna Array," *IEEE APS International Symposium Digest*, Montreal, Canada, 1997, pp. 1024-1027.

Preston, S.L., et al., "Base-Station Tracking in Mobile Communications Using a Switched Parasitic Antenna Array," *IEEE Trans. Antennas and Propagation*, vol. 46, No. 6, Jun. 1998, pp. 841-844.

Preston, S.L., et al., "Systematic Approach to the Design of Directional Antennas Using Switched Parasitic and Switched Active Elements," *Asia Pacific Microwave Conference Proceedings*, Yokohama, Japan, 1998, pp. 531-534.

Preston, S.L., et al., "Size Reduction of Switched Parasitic Directional Antennas Using Genetic Algorithm Optimisation Techniques," *Asia Pacific Microwave Conference Proceedings*, Yokohama, Japan, 1998, pp. 1401-1404.

Preston, S.L., et al., "A Multibeam Antenna Using Switched Parasitic and Switched Active Elements for Space-Division Multiple Access Applications," *IEICE Trans. Electron.*, vol. E82-C, No. 7, Jul. 1999, pp. 1202-1210.

Preston, S.L., et al., "Electronic Beam Steering Using Switched Parasitic Patch Elements," *Electronics Letters*, vol. 33, No. 1, Jan. 2, 1997, pp. 7-8.

Ruze, J., "Lateral-Feed Displacement in a Paraboloid," *IEEE Trans. Antennas and Propagation*, vol. 13, 1965, pp. 660-665.

Scott, N.L., et al., "Diversity Gain from a Single-Port Adaptive Antenna Using Switched Parasitic Elements Illustrated with a Wire and Monopole Prototype," *IEEE Trans. Antennas and Propagation*, vol. 47, No. 6, Jun. 1999, pp. 1066-1070.

Sibille, A. et al., "Circular Switched Monopole Arrays for Beam Steering Wireless Communications," *Electronics Letters*, vol. 33, No. 7, Mar. 1997, pp. 551-552.

Vaughn, R., "Switched Parasitic Elements for Antenna Diversity," *IEEE Trans. Antennas and Propagation*, vol. 47, No. 2, Feb. 1999, pp. 399-405.

* cited by examiner

ADAPTIVE ANTENNA FOR USE IN WIRELESS COMMUNICATION SYSTEMS

RELATED APPLICATION(S)

This application is a Divisional of U.S. application Ser. No. 10/744,912, filed Dec. 23, 2003 now U.S. Pat. No. 6,989,797, entitled "Adaptive Antenna for Use in Wireless Communication Systems," which is a Continuation-In-Part of U.S. application Ser. No. 10/441,977 filed May 20, 2003 now abandoned, entitled "Adaptive Antenna for Use in Wireless Communication Systems," which is a Divisional of U.S. application Ser. No. 09/859,001, filed on May 16, 2001, now U.S. Pat. No. 6,600,456, issued Jul. 29, 2003, which claims the benefit of U.S. Provisional Application No. 60/234,485, filed on Sep. 22, 2000, and is a Continuation-In-Part of U.S. patent application Ser. No. 09/579,084 filed on May 25, 2000, now U.S. Pat. No. 6,304,215, which is a Divisional of U.S. application Ser. No. 09/210,117, filed on Dec. 11, 1998, now issued U.S. Pat. No. 6,100,843, which is a continuation of U.S. patent application Ser. No. 09/157,736 filed on Sep. 21, 1998, now abandoned. The entire teachings of the above applications are incorporated herein by reference.

FIELD OF THE INVENTION

This invention relates to wireless communication systems, and more particularly to an antenna apparatus for use by mobile subscriber units in a TDMA, CDMA, FDMA, or GSM wireless network or by a client station in an Wireless Local Area Network (WLAN), such as an 802.11 network, to provide beamforming transmission and reception capabilities.

BACKGROUND OF THE INVENTION

Code Division Multiple Access (CDMA) communication systems may be used to provide wireless communications between a base station and one or more mobile subscriber units. The base station is typically a computer controlled set of transceivers that are interconnected to a land-based public switched telephone network (PSTN). The base station includes an antenna apparatus for sending forward link radio frequency signals to the mobile subscriber units. The base station antenna is also responsible for receiving reverse link radio frequency signals transmitted from each mobile unit. Each mobile subscriber unit also contains an antenna apparatus for the reception of the forward link signals and for transmission of the reverse links signals. A typical mobile subscriber unit is a digital cellular telephone handset or a personal computer coupled to a cellular modem. In CDMA cellular systems, multiple mobile subscriber units may transmit and receive signals on the same frequency but with different codes, to permit detection of signals on a per unit basis.

The most common type of antenna used to transmit and receive signals at a mobile subscriber unit is a mono- or omni-pole antenna. This type of antenna consists of a single wire or antenna element that is coupled to a transceiver within the subscriber unit. The transceiver receives reverse link signals to be transmitted from circuitry within the subscriber unit and modulates the signals onto the antenna element at a specific frequency assigned to that subscriber unit. Forward link signals received by the antenna element at a specific frequency are demodulated by the transceiver and supplied to processing circuitry within the subscriber unit.

The signal transmitted from a monopole antenna is omnidirectional in nature. That is, the signal is sent with the same signal strength in all directions in a generally horizontal plane. Reception of a signal with a monopole antenna element is likewise omnidirectional. A monopole antenna does not differentiate in its ability to detect a signal in one direction versus detection of the same or a different signal coming from another direction.

A second type of antenna which may be used by mobile subscriber units is described in U.S. Pat. No. 5,617,102. The system described therein provides a directional antenna comprising two antenna elements mounted on the outer case of a laptop computer. The system includes a phase shifter attached to the two elements. The phase shifter may be switched on or off in order to affect the phase of signals transmitted or received during communications to and from the computer. By switching the phase shifter on, the antenna transmit pattern may be adapted to a predetermined hemispherical pattern which provides transmit beam pattern areas having a concentrated signal strength or gain. The dual element antenna directs the signal into predetermined quadrants or hemispheres to allow for large changes in orientation relative to the base station while minimizing signal loss.

CDMA cellular systems are also recognized as being interference limited systems. That is, as more mobile subscriber units become active in a cell and in adjacent cells, frequency interference becomes greater and thus error rates increase. As error rates increase, maximum data rates decrease. Thus, another method by which data rate can be increased in a CDMA system is to decrease the number of active mobile subscriber units, thus clearing the airwaves of potential interference. For instance, to increase a current maximum available data rate by a factor of two, the number of active mobile subscriber units can be decreased by one half. However, this is rarely an effective mechanism to increase data rates due to a lack of priority amongst users.

SUMMARY OF THE INVENTION

Various problems are inherent in prior art antennas used on mobile subscriber units in wireless communications systems, such as CDMA cellular systems, and client stations in Wireless Local Area Network (WLAN) systems, e.g., 802.11 systems. One such problem is called multipath fading. In multipath fading, a radio frequency signal transmitted from a sender (either base station or mobile subscriber unit) may encounter interference on route to an intended receiver. The signal may, for example, be reflected from objects such as buildings that are not in the direct path of transmission, but that redirect a reflected version of the original signal to the receiver. In such instances, the receiver receives two versions of the same radio signal: the original version and a reflected version. Since each received signal is at the same frequency but the reflected signal may be out of phase with the original due to reflection and a longer transmission path, the original and reflected signals may tend to cancel each other out. This results in fading or dropouts in the received signal, hence the term multipath fading.

Single element antennas are highly susceptible to multipath fading. A single element antenna has no way of determining the direction from which a transmitted signal is sent and cannot be tuned or attenuated to more accurately detect and receive a signal in any particular direction.

The dual element antenna described in the aforementioned reference is also susceptible to multipath fading, due to the symmetrical nature of the hemispherical lobes formed by the antenna pattern when the phase shifter is activated. Since the lobes created in the antenna pattern are more or less symmetrical and opposite from one another, a signal reflected in a reverse direction from its origin can be received with as much power as the original signal that is directly received. That is, if the original signal reflects from an object beyond or behind the intended receiver (with respect to the sender) and reflects back at the intended receiver from the opposite direction as the directly received signal, a phase difference in the two signals can create a multipath fading situation.

Another problem present in cellular communication systems is intercell interference. Most cellular systems are divided into individual cells, with each cell having a base station located at its center. The placement of each base station is arranged such that neighboring base stations are located at approximately sixty degree intervals from each other. In essence, each cell may be viewed as a six sided polygon with a base station at the center. The edges of each cell adjoin each other and many cells form a honeycomb like image if each cell edge were to be drawn as a line and all cells were viewed from above. The distance from the edge of a cell to its base station is typically driven by the maximum amount of power that is to be required to transmit an acceptable signal from a mobile subscriber unit located near the edge of a cell to that cell's base station (i.e., the power required to transmit an acceptable signal a distance equal to the radius of one cell).

Intercell interference occurs when a mobile subscriber unit near the edge of one cell transmits a signal that crosses over the edge of a neighboring cell and interferes with communications taking place within the neighboring cell. Typically, intercell interference occurs when similar frequencies are used for communication in neighboring cells. The problem of intercell interference is compounded by the fact that subscriber units near the edges of a cell typically use higher transmit powers so that the signals they transmit can be effectively received by the intended base station located at the cell center. Consider that another mobile subscriber unit located beyond or behind the intended receiver may be presented at the same power level, representing additional interference.

The intercell interference problem is exacerbated in CDMA systems, since the subscriber units in adjacent cells may typically be transmitting on the same frequency. What is needed is a way to reduce the subscriber unit antenna's apparent field of view, which can have a marked effect on the operation of the forward link (base to subscriber unit or access point to client station) by reducing the apparent number of interfering transmissions. A similar improvement is needed for the reverse link, so that the transmitted signal power needed to achieve a particular receive signal quality could be reduced.

Accordingly, the present invention provides an inexpensive antenna apparatus for use with a mobile subscriber unit in a wireless same frequency communication system, such as a CDMA cellular communication system, or for use with a client station in a WLAN system, such as an 802.11 system, employing same frequency techniques or multiple frequency band techniques.

The present invention provides a precise mechanism for determining in which direction the base station or access point assigned to the mobile subscriber unit or client station, respectively, is located and provides a means for configuring the antenna apparatus to maximize the effective radiated and/or received energy. The antenna apparatus includes at least one active antenna element that transmits and receives RF energy, multiple passive antenna elements that re-radiate the RF energy, and a like number of selective impedance components, each respectively coupled to one of the passive antenna elements. The selectable impedance components are independently adjustable (i.e., programmable) to affect the direction of the beam produced by the directive antenna. Thus, forward and reverse links have improved gain.

The selectable impedance components are independently adjustable to make the associated antenna elements reflective or transmissive. Reflective antenna elements are, in effect, elongated, causing reflection of RF signals. Transmissive antenna elements are, in effect, shortened, allowing RF signals from the active antenna element(s) to propagate past them. Through proper coordination of the passive antenna elements, the subscriber unit uses the directive antenna to direct the beam to reduce multipath fading and intercell interference.

In one embodiment, the antenna apparatus is allowed to adapt to various orientations with respect to the base station or access point. In this embodiment, the antenna apparatus also includes a controller coupled to the selectable impedance components. The controller determines an optimal impedance setting for each selectable impedance component. The proper phase, set by the associated impedance component, of each passive antenna element may, for example, be determined by monitoring an optimum response to a pilot signal transmitted from the base station or access point. The antenna apparatus thus acts as a beamformer for transmission of signals from the subscriber unit or client station and acts as a directive antenna for signals received by the subscriber unit or client station.

Through the use of an array having at least one active antenna element and multiple passive antenna elements each having a programmable re-radiation phase, the antenna apparatus is estimated to increase the effective transmit power per bit transmitted by as much as 3 decibels (dB) for reverse link communications over classic phased array antenna configurations, which provide 4.5 dB. Thus, the number of active subscriber units or client stations in a cell may remain the same while the antenna apparatus of this invention increases data rates for each subscriber unit or client station beyond those achievable by prior art antennas. Alternatively, if data rates are maintained at a given rate, more subscriber units or client stations may be active at the same time in a single cell using the antenna apparatus described herein. In either case, the capacity of a cell is increased, as measured by the sum total of data being communicated at any moment in time.

Forward link communication capacity can be increased as well, due to the directional reception capabilities of the antenna apparatus. Since the antenna apparatus is less susceptible to interference from adjacent cells, the forward link capacity can be increased by adding more users or by increasing cell radius size.

The base station or access point may also be equipped with a directional antenna apparatus and execute processes associated with the operation of the antenna apparatus as described in reference to operation by a subscriber unit or client station.

With respect to the physical implementation of the antenna apparatus, one embodiment of the invention specifies that a central, active, antenna element is encircled by multiple passive antenna elements mounted on a planar surface having a single ground plane layer. Electrical coupling to the ground plane is implemented through switches coupling the associated antenna elements to respective, fixed, impedance components, such as a delay line, capacitor, inductor, lumped impedance, or adjustable impedance component, such as a varactor. Other embodiments specify that more than one active antenna element is employed along with an associated feed network, forming an antenna array surrounded by multiple, passive, antenna elements.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
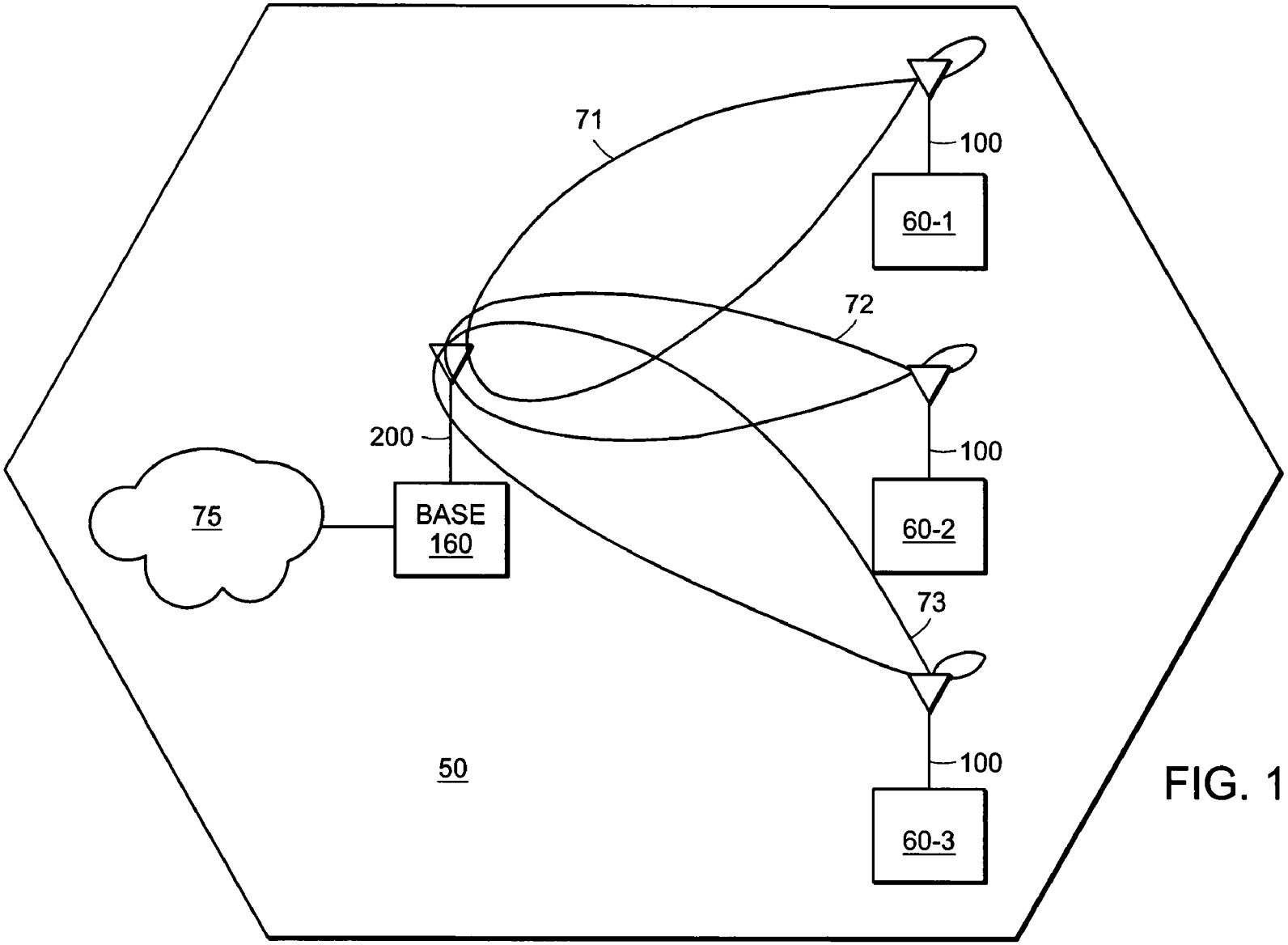
FIG. 1 illustrates a cell of a CDMA cellular communications system.

FIG. 1 illustrates one cell 50 of a typical CDMA cellular communication system or a Wireless Local Area Network (WLAN), such as an 802.11 network. In a CDMA cellular communication system, the cell 50 represents a geographical area in which mobile subscriber units 60-1 through 60-3 communicate with centrally located base station 160. In the WLAN, the cell represents a geographical area in which client stations 60-1 through 60-3 communicate with a centrally located Access Point (AP) 160. For purposes of illustrating the principles of the present invention, the embodiment disclosed is that of a CDMA cellular communication system; however, the principles apply similarly to a WLAN unless otherwise specified. Thus, it should be understood that descriptions of a base station 160 apply to an access point 160 and descriptions of mobile subscriber units 60-1 through 60-3 apply to client stations 60-1 through 60-3. The base station 160 or access point 160 may be referred to more generally herein as a network connection unit 160, and the mobile subscriber units 60-1 through 60-3 and client stations 60-1 through 60-3 may be referred to more generally herein as field units 160.

Continuing to refer to FIG. 1, each subscriber unit 60 is equipped with an antenna 100 configured according to this invention. The subscriber units 60 provide wireless data and/or voice services and can connect devices such as, for example, laptop computers, portable computers, personal digital assistants (PDAs) or the like through base station 160 to a network 75, which can be a Public Switched Telephone Network (PSTN), packet switched computer network, or other data network, such as the Internet or a private intranet. The base station 160 may communicate with the network 75 over any number of different efficient communication protocols, such as primary rate Integrated Services Digital Networks (ISDN), or other Link Access Procedure-D (LAPD) based protocols, such as IS-634 or V5.2, or even TCP/IP if network 75 is an Ethernet network, such as the Internet. The subscriber units 101 may be mobile in nature and may travel from one location to another while communicating with base station 104.

FIG. 1 illustrates one base station 160 and three mobile subscriber units 60 in the cell 50 by way of example only and for ease of description of the invention. The invention is applicable to systems in which there are typically many more subscriber units communicating with one or more base stations in an individual cell, such as cell 50.

It is also to be understood by those skilled in the art that FIG. 1 may be a standard cellular type communication system such as a CDMA, TDMA, GSM or other system in which the radio channels are assigned to carry data and/or voice or between the base stations 104 and subscriber units 101. In a preferred embodiment, FIG. 1 is a CDMA-like system, using code division multiplexing principles, such as those defined in the IS-95B standards for the air interface.

The invention provides the mobile subscriber units 60 with an antenna 100 that provides directional reception of forward link radio signals transmitted from base station 160, as well as providing directional transmission of reverse link signals, via a process called beamforming, from the mobile subscriber units 60 to the base station 160. This concept is illustrated in FIG. 1 by the example beam patterns 71 through 73, which extend outwardly from each mobile subscriber unit 60 more or less in a direction for best propagation towards the base station 160. By being able to direct transmission more or less towards the base station 160, and by being able to directively receive signals originating more or less from the location of the base station 160, the antenna apparatus 100 reduces the effects of intercell interference and multipath fading for mobile subscriber units 60. Moreover, since the transmission beam patterns 71, 72 and 73 are extended outward in the direction of the base station 160 but are attenuated in most other directions, less power is required for transmission of effective communication signals from the mobile subscriber units 60-1, 60-2 and 60-3 to the base station 160.

It should be understood that the base station 160 may also be equipped with a directional antenna apparatus 100. The base station 160 generally operates in omni-directional mode but may engage the directivity properties of the antenna apparatus 100 for similar reasons as a subscriber unit 60 or reasons particular to a base station 160, such as peak time of day reasons (e.g., rush hour highway traffic), priority service, emergency service, and so forth. Thus, the description below is presented with respect to a subscriber unit 60 using the antenna apparatus 100; however, the same principles apply to the base station 160 employing the antenna apparatus 100.

Figure 2:
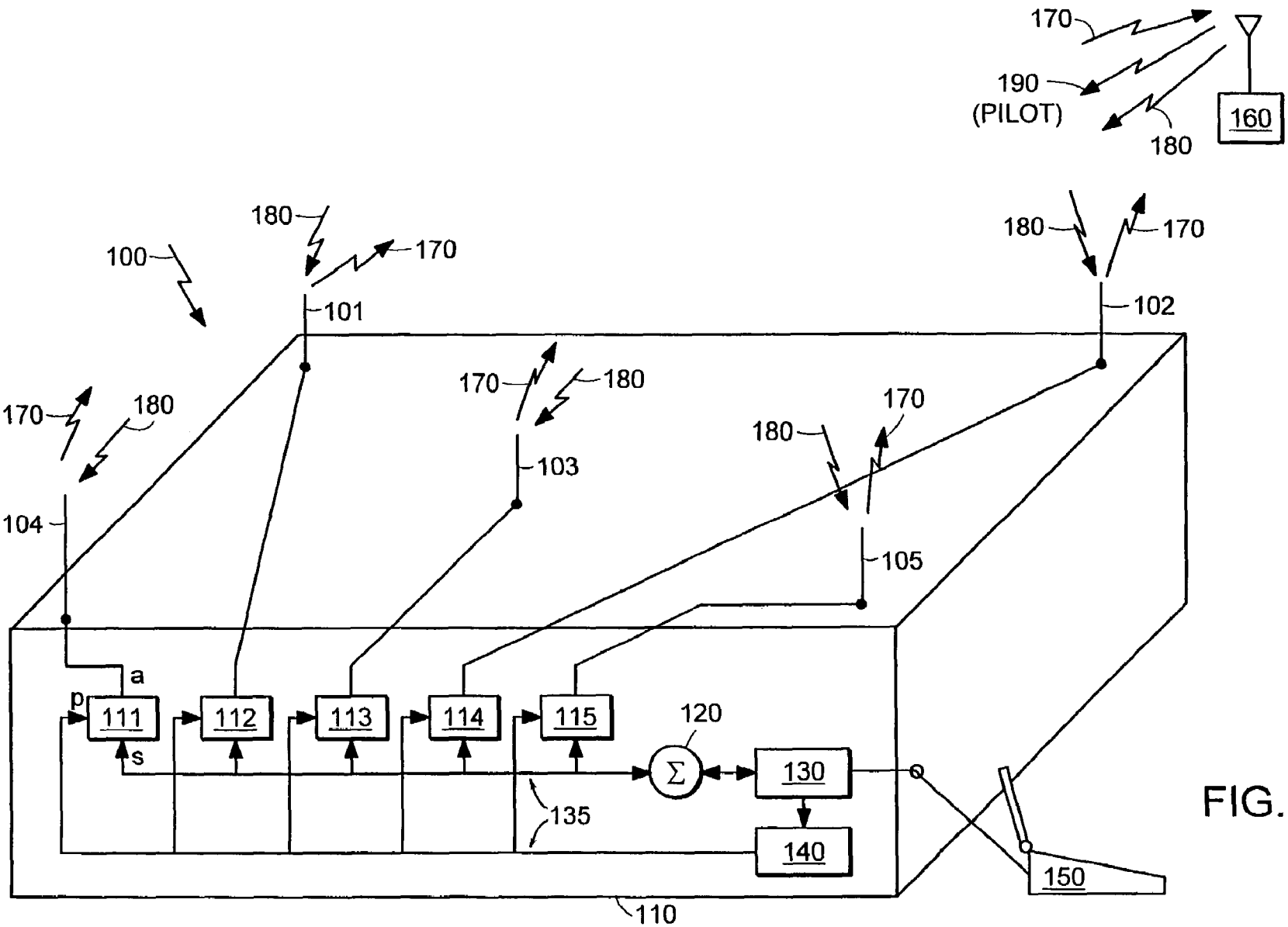
FIG. 2 illustrates a preferred configuration of an antenna apparatus used by a mobile subscriber unit in a cellular system or client station in a WLAN system according to this invention.

FIG. 2 illustrates a detailed isometric view of a mobile subscriber unit 60 and an associated antenna apparatus 100 configured according to the present invention. The antenna apparatus 100 includes a platform or housing 110 upon which are mounted five antenna elements 101 through 105. Within the housing 110, the antenna apparatus 100 includes phase shifters 111 through 115, a bi-directional summation network or splitter/combiner 120, transceiver 130, and control processor 140, which are all interconnected via a bus 135. As illustrated, the antenna apparatus 100 is coupled via the transceiver 130 to a laptop computer 150 (not drawn to scale). The antenna apparatus 100 allows the laptop computer 150 to perform wireless data communications via forward link signals 180 transmitted from base station 160 and reverse link signals 170 transmitted to base station 160.

In a preferred embodiment, each antenna element 101 through 105 is disposed on the surface of the housing 110 as illustrated in the figure. In this preferred embodiment, four elements 101, 102, 104 and 105 are respectively positioned at locations corresponding to corners of a square, and a fifth antenna element 103 is positioned at a location corresponding to a center of the square. The distance between each element 101 through 105 is great enough so that the phase relationship between a signal received by more than one element 101 through 105 will be somewhat out of phase with other elements that also receive the same signal, assuming all elements 101 through 105 have the same phase setting as determine by phase shifters 111 through 115. That is, if the phase setting of each element 101 through 105 were the same, each element 101 through 105 would receive the signal somewhat out of phase with the other elements.

However, according to the operation of the apparatus antenna 100 in this invention, the phase shifters 111 through 115 are independently adjustable to affect the directionality of signals to be transmitted and/or received to or from the subscriber unit (i.e., laptop computer 150 in this example). By properly adjusting the phase for each element 101 through 105, during signal transmission, a composite beam is formed which may be positionally directed towards the base station 160. That is, the optimal phase setting for sending a reverse link signal 170 from the antenna apparatus 100 is a phase setting for each antenna element 101 through 105 that creates a directional reverse link signal beamformer. The result is an antenna apparatus 100 which directs a stronger reverse link signal pattern in the direction of the intended receiver base station 160.

The phase settings used for transmission also cause the elements 101 to 105 to optimally receive forward link signals 180 that are transmitted from the base station 160. Due to the programmable nature and the independent phase setting of each element 101 through 105, only forward link signals 180 arriving from a direction that is more or less in the location of the base station 160 are optimally received. The elements 101 through 105 naturally reject other signals that are not transmitted from a similar location as are the forward link signals. In other words, a directional antenna is formed by independently adjusting the phase of each element 101 through 105.

The summation network 120 is coupled to the signal terminal 15 of each phase shifter 111 through 115. During transmission, the summation network 120 provides respective reverse link signals to be transmitted by each of the phase shifters 111 through 115. The phase shifters 111 through 115 shift the phase of the reverse link signal by a phase setting associated with that particular phase shifter 111 through 115, respectively, as set by a phase shift control input, p. By shifting the phase of the transmitted reverse link signals 170 from each element 101 through 105, certain portions of the transmitted signal 170 that propagates from each element 101 through 105 will be more in phase with other portions of other signals 170 from other elements 101 through 105. In this manner, the portions of signals that are more in phase with each other will combine to form a strong composite beam for the reverse link signals 170. The amount of phase shift provided to each antenna element 101 through 105 determines the direction in which the stronger composite beam will be transmitted.

The phase settings used for transmission from each element 101 through 105, as noted above, provide a similar physical effect on a forward link frequency signal 180 that is received from the base station 160. That is, as each element 101 through 105 receives a signal 180 from the base station 160, the respective received signals will initially be out of phase with each other due to the location of each element 101 through 105 upon base 110. However, each received signal is phase-adjusted by the phase shifters 111 through 115. The adjustment brings each signal in phase with the other received signals 180. Accordingly, when each signal is summed by the summation network 120, the composite received signal will be accurate and strong.

To optimally set the phase shift for each phase shifter 111 through 115 in antenna 100, phase control values are provided by the controller 140. Generally, in the preferred embodiment, the controller 140 determines these optimum phase settings during idle periods when laptop computer 150 is neither transmitting nor receiving data via antenna 100. During this time, a received signal, for example, a forward link pilot signal 190, that is continuously sent from base station 160 and that is received on each antenna element 101 through 105. That is, during idle periods, the phase shifters 111 through 115 are adjusted to optimize reception of the pilot signal 190 from base station 160, such as by maximizing the received signal energy or other link quality metric.

The processor 140 thus determines an optimal phase setting for each antenna element 101 through 105 based on an optimized reception of a current pilot signal 190. The processor 140 then provides and sets the optimal phase for each adjustable phase shifter 111 through 115. When the antenna apparatus 100 enters an active mode for transmission or reception of signals between the base station 160 and the laptop 150, the phase setting of each phase shifter 111 through 115 remains as set during the previous idle time period.

Before a detailed description of phase setting computation as performed by the processor 140 is given, it should be understood that the invention is based in part on the observation that the location of the base station 160 in relation to any one mobile subscriber unit (i.e., laptop 150) is approximately circumferential in nature. That is, if a circle were drawn around a mobile subscriber unit and different locations are assumed to have a minimum of one degree of granularity between any two locations, the base station 160 can be located at any of a number of different possible angular locations. Assuming accuracy to one degree, for example, there are 360 different possible phase setting combinations that exist for an antenna 100. Each phase setting combination can be thought of as a set of five phase shift values, one for each antenna element 101 through 105.

There are, in general, at least two different approaches to finding the optimized phase shift values. In the first approach, the controller 140 performs a type of optimized search in which all possible phase setting combinations are tried. For each phase setting (in this case, for each one of the 360 angular settings), five precalculated phase values are read, such as from memory storage locations in the controller 140, and then applied to the respective phase shifters 111 through 115. The response of the receiver 130 is then detected by the controller 140. After testing all possible angles, the one having the best recover response, such as measured by maximum signal to noise ratio (the ratio of energy per bit, Eb, or energy per chip, Ec, to total interference, Io).

In a second approach, each phase shift value is individually determined by allowing it to vary while the other phase values are held constant. This perturbational approach iteratively arrives at an optimum value for each of the five phase settings.

Figure 3:
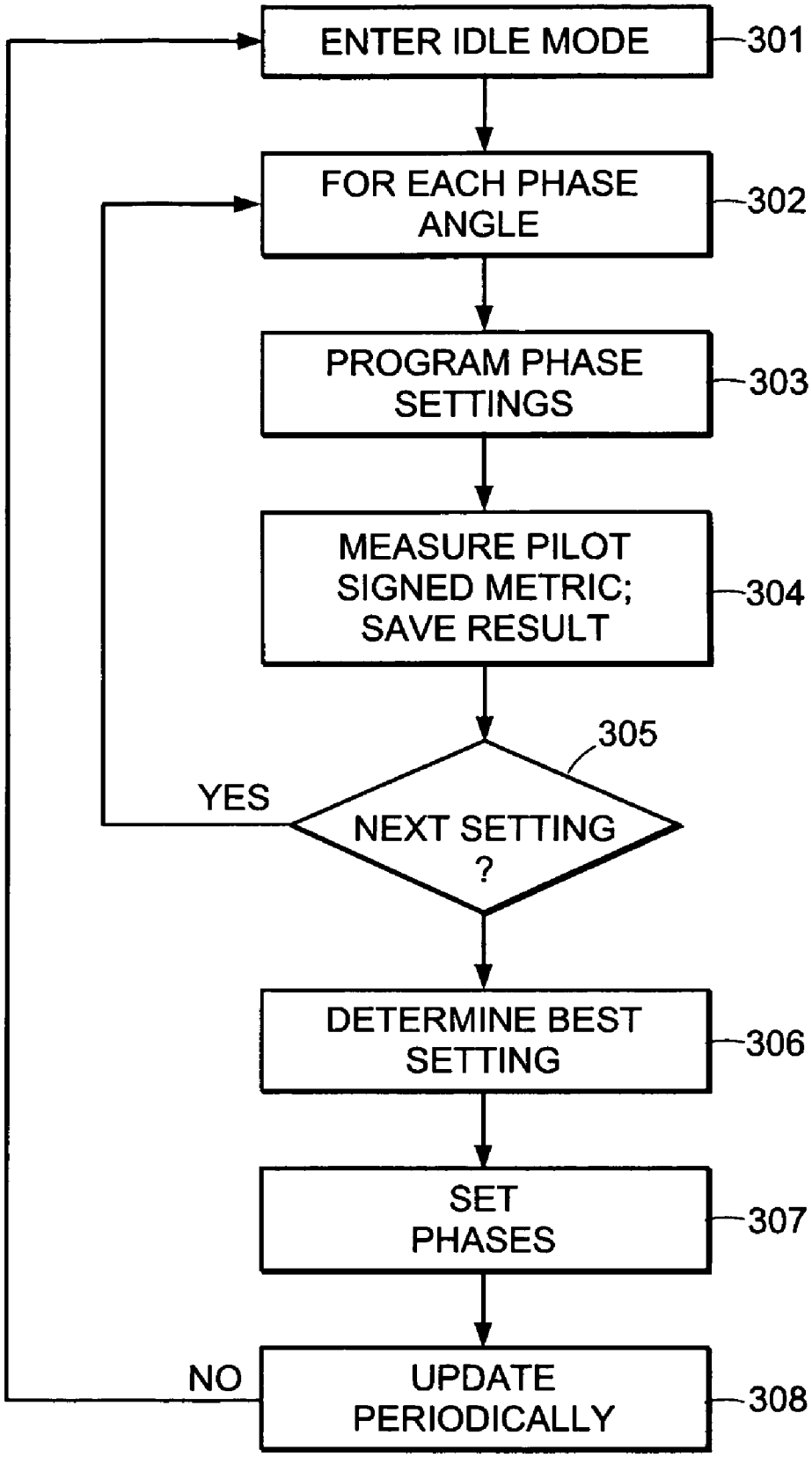
FIG. 3 is a flow chart of the processing steps performed to optimally set the phase of each antenna element.

FIG. 3 shows steps 301 through 306 performed by the controller 140 according to one embodiment of the invention. In order to determine the optimal phase settings for phase shifters 111 through 115 by the first "search" method, steps 301 through 306 are performed during idle periods of data reception or transmission, such as when a pilot signal 190 is being transmitted by the base station 160.

In step 301, the controller 140 determines that the idle mode has been entered, such as by detecting certain forward link signals 180. Step 302 then begins a loop that will execute once for each possible angle or location at which the base station 160 may be located. In the preferred embodiment, this loop is executed 360 times. Step 303 then programs each phase shifter 111 through 115 with a phase setting corresponding to the first location (i.e., angle 0) setting. The phase settings may, for example, be precalculated and stored in a table, with five phase shift setting for each possible angle corresponding to the five elements of the array. In other words, step 303 programs phase settings for a first angle, which may be conceptualized as angle 0 in a 360 degree circle surrounding the mobile subscriber unit 60. Step 304 then measures the received pilot signal 190, as output from the summation network 120. The measurement in step 304 reflects how well each antenna element 101 through 105 detected the received pilot signal 190 based upon the current set of programmed phase settings applied in step 303. Step 304 saves the measurement as a received signal metric value. The metric may, for example, be a link quality metric as bit error rate or noise energy level per chip (Ec/No).

Step 305 then returns processing to step 302 to program the phase shifters for the next set of phase settings. Steps 302 through 305 repeat until all 360 sets of phase settings have been programmed into phase shifters 111 through 115 (step 303) and a measurement has been taken of the received pilot signal 190 for each of these settings (Step 304). After step 305 determines there are no more set of phase settings, step 306 determines the best set of phase settings as determined by which settings produced the strongest receive signal metric value. Step 307 then programs the phase shifters 111 through 115 with the set of phase settings that was determined to produce this best result.

During long periods of idle time, step 308 is executed which repeats the process periodically. Step 308 accounts for the fact that the antenna 100 might be moved and re-oriented during idle periods, thus affecting the direction and orientation of the base station in relation to the antenna 100.

In addition, the antenna may be optimized during transmission. In this manner, steps 301 through 308 continuously update and set optimal phase setting for each antenna element 101 through 105.

Figure 4:
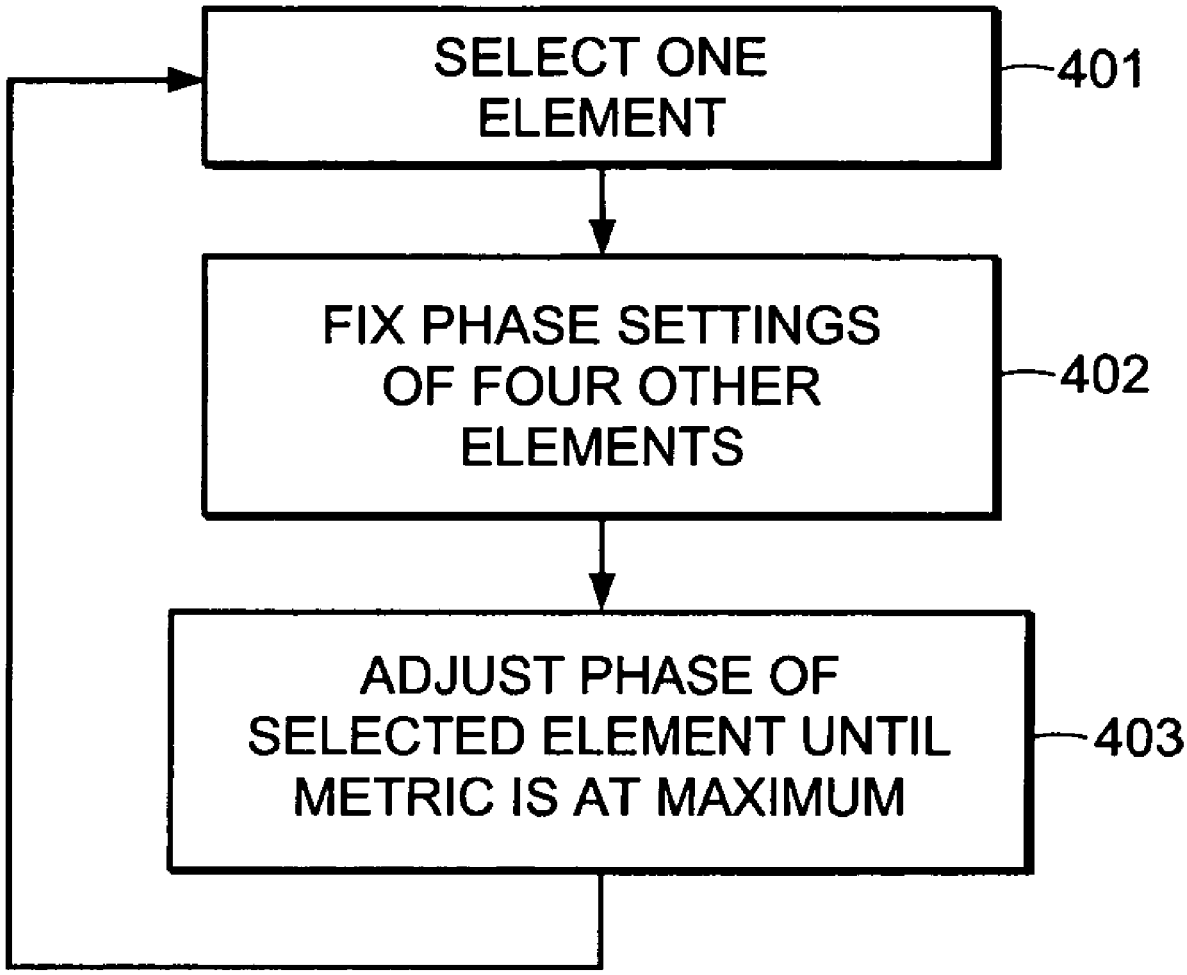
FIG. 4 is a flow chart of steps performed by a perturbational algorithm to optimally determine the phase settings of antenna elements.

FIG. 4 shows processing steps for an alternative method for determining the optimal phase setting of antenna elements 101 through 105 is to use a perturbational algorithm. Generally, this method uses a perturbational algorithm to determine phase settings in the form of weights for each antenna element 101 through 105.

In step 401, one of the antenna elements 101 through 105 is selected. In step 402, the phase settings of the four remaining elements not selected in step 400 are fixed in value. Step 403 then varies the phase setting of the non-fixed element selected in step 401 until the setting which maximizes the pilot signal metric is determined. Then, the process repeats by returning to step 401 where the previously selected element is fixed to this optimum phase and the phase setting of one of the other elements is varied. The process continues until each element is configured with an optimal setting. As the process iterates, the phase settings of each element converge to an optimum setting.

Figure 5:
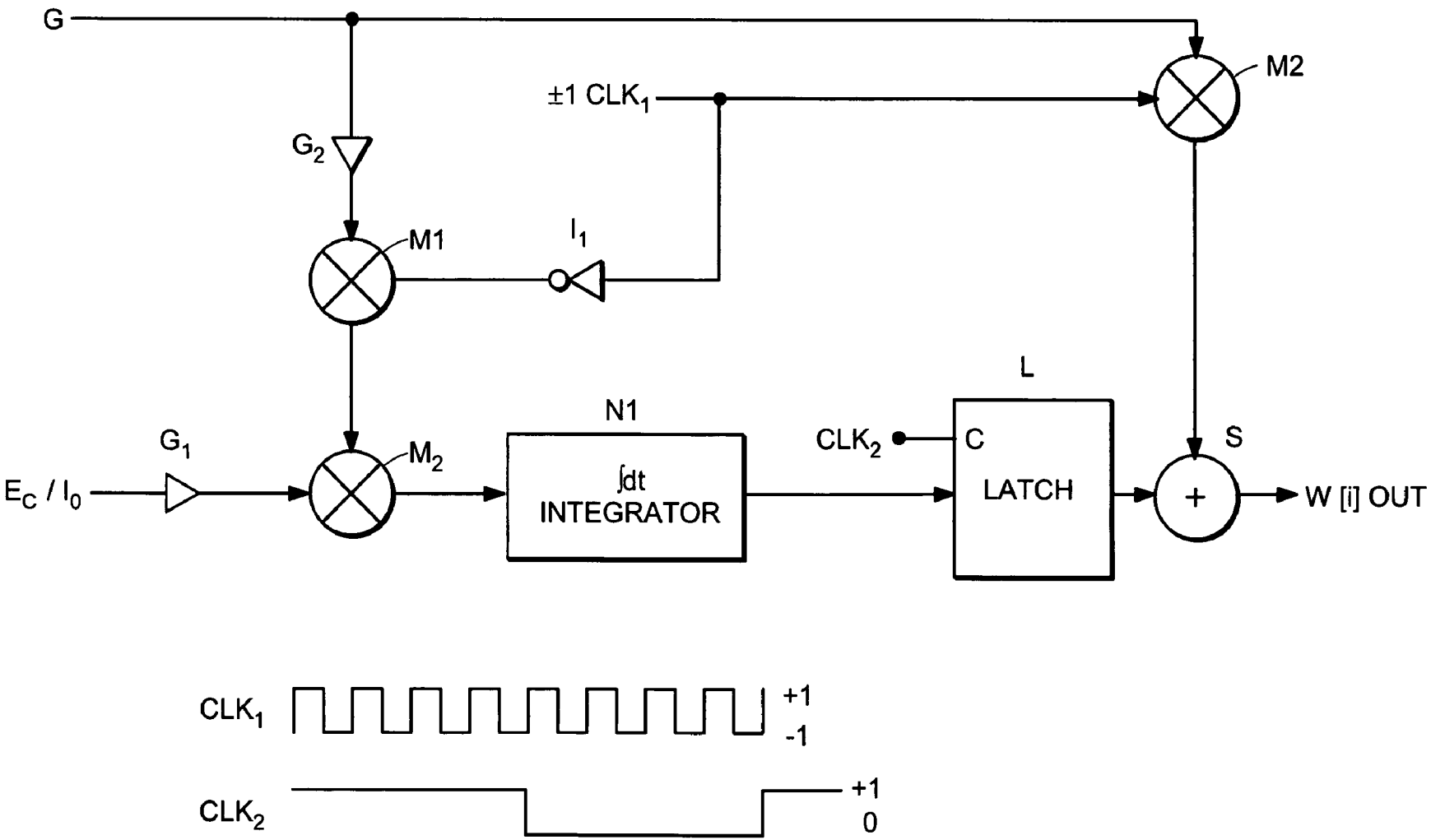
FIG. 5 illustrates a flow diagram for a perturbational computational algorithm for computing the phase weights to be assigned to each antenna element.

FIG. 5 illustrates a more detailed flow diagram for implementing a perturbational algorithm to determine optimal phase settings for each antenna element. The flow diagram in FIG. 5 may be used in place of the processing steps performed by the controller 140 in FIG. 3.

The process fixes a value for four of the five unknown, optimum phase shifts W[i], e.g. W[2] through W[5]. The process perturbs the system and observes the response, adapting to find the optimum value for the unfixed phase value, e.g. W[1]. The measured link quality metric, in this case Ec/Io, is fed to a first gain block G1. Again input G is fed to a second gain block G2. A first fast "clock" date value, CLK1, which alternates from a value of "1" to a value of "−1" is inverted by I1 and fed to a first multiplier M1. The other input of multiplier M1 is fed by the gain block G2.

The output of m1 is fed to a second multiplier M2 together with the output of G1. An integrator N1 measures an average level and provides this to the latch L. A slow clock CLK2, typically alternating at a rate which varies between "1" and "0" and is much slower than CLK1, by at least 100 times, drives the latch "clock" C. The output of the latch L is summed by summation block S with the non-inverted output of M2. The result, W[i], is a value which tends to seek a localized minima of the function.

The process shown in FIG. 5 is then repeated by setting the first unfixed phase value W[1] to the derived value, setting W[3] to W[5] to a fixed value and letting w[2] be the output of this process. The process continues to find optimum values for each of the five unknown phase values.

Alternatively, instead of varying a phase assigned to each antenna element 101 through 105, the phase setting for each element can be stored in a table of vectors, each vector having assignments for the five elements 101 through 105. The five values in each vector can be computed based upon the angle of arrival of the received pilot signal. That is, the values for each antenna element are set according to the direction in which the base station is located in relation to the mobile subscriber unit. The angle of arrival can be used as a value to lookup the proper vector of weights (and/or phase settings) in the table. By using a table with vectors, only the single angle of arrival calculation needs to be performed to properly set the phase settings of each element 101 through 105.

Figure 6A:
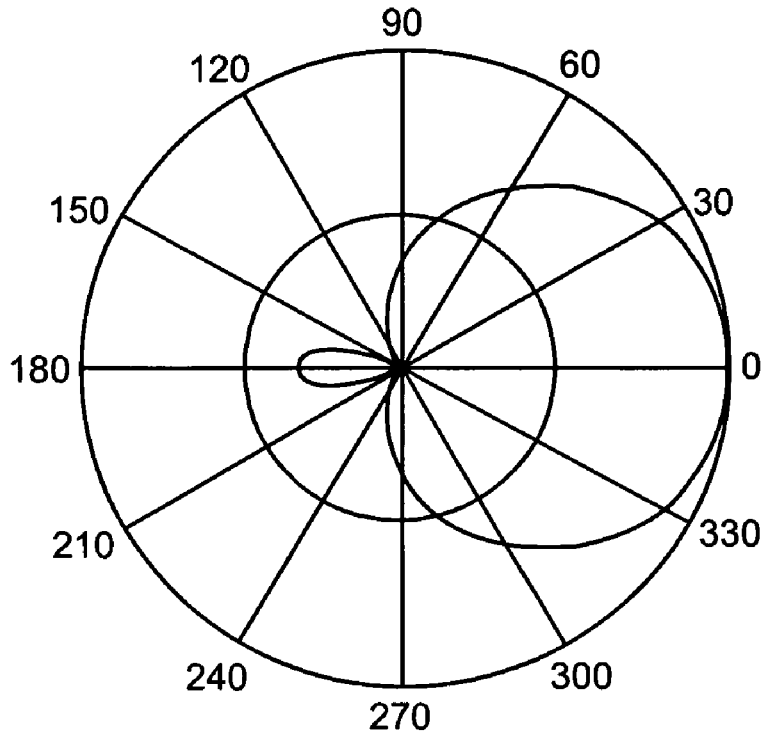
FIG. 6A is a graph of a beam pattern directed to zero degrees East by an antenna configured according to the invention.

FIG. 6A is a graph of a model of a beam pattern which obtained via an optimal phase setting directed towards a base station located at position corresponding to zero degrees (i.e., to the right of the figure). As illustrated in FIG. 6A, the invention provides a directed signals that helps to avoid the problems of multipath fading and intercell interference.

Figure 6B:
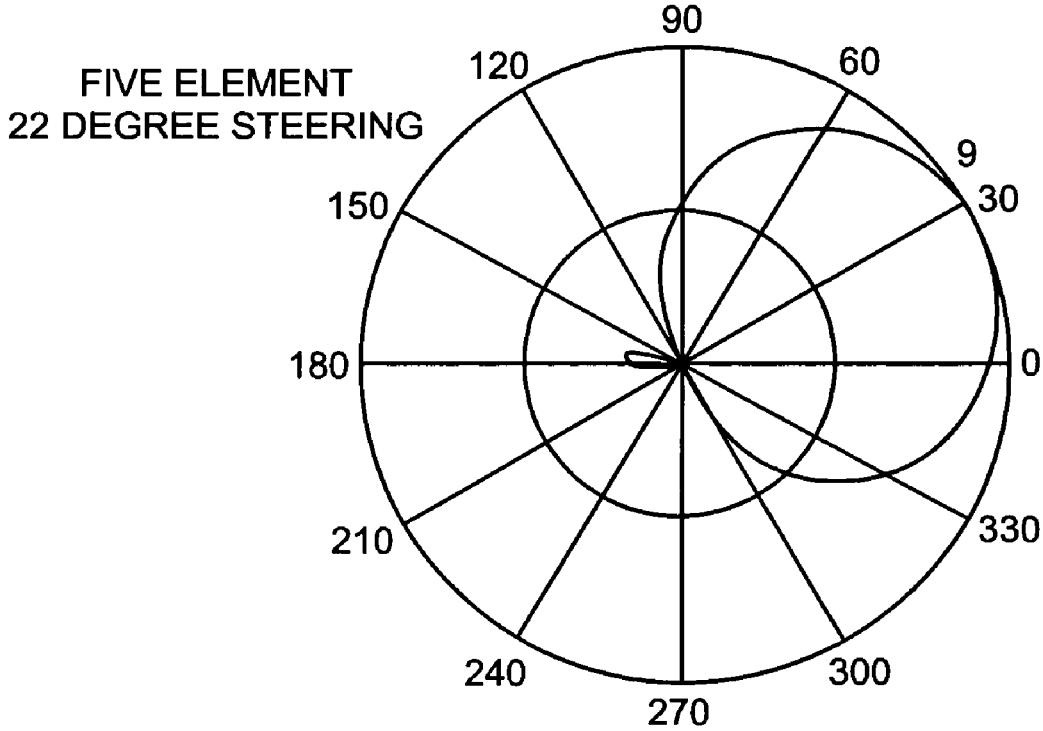
FIG. 6B is a graph of a beam pattern directed to twenty two degrees East by an antenna configured according to the invention.

FIG. 6B is a graph of another beam pattern model obtained by steering the beam twenty-two degrees north east upon detection of movement of the mobile subscriber unit. As illustrated, by adjusting the phase of each passive antenna element 701 through 705, the beam may be steered to an optimal position for transmission and for reception of radio signals.

Figure 6C:
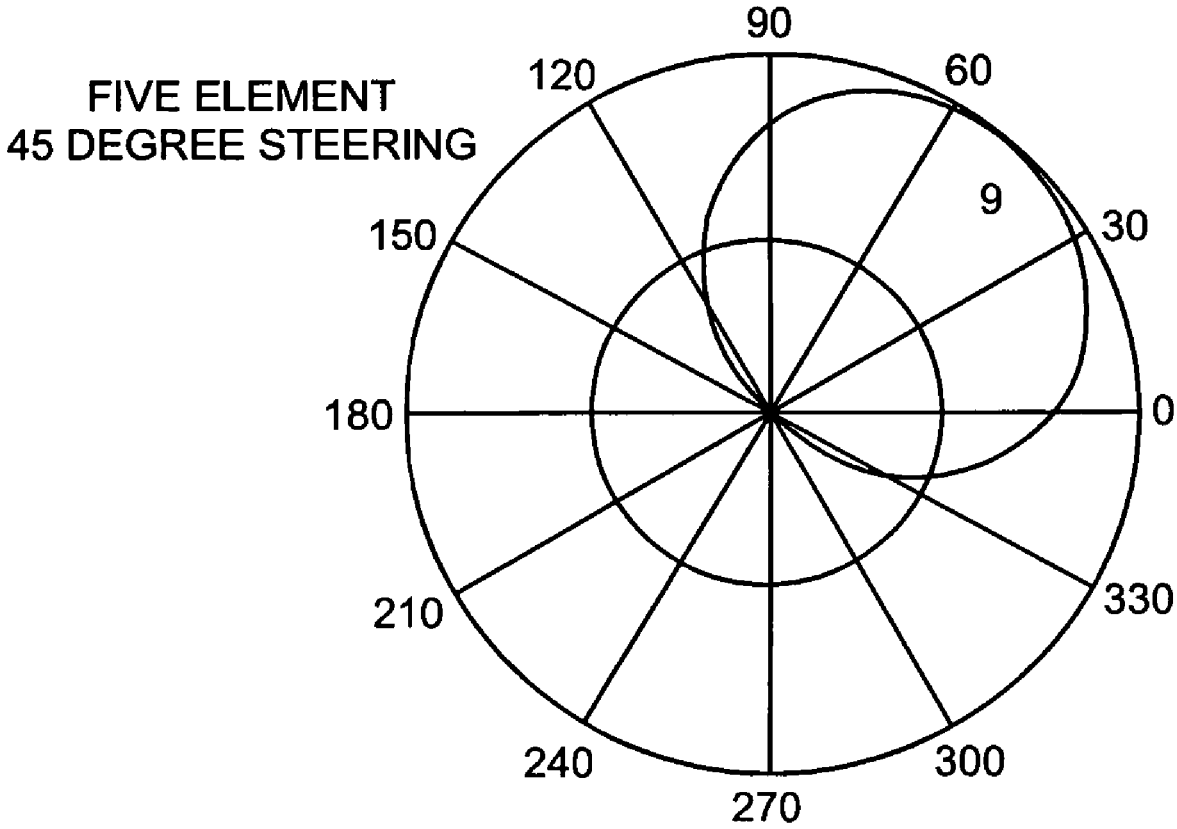
FIG. 6C is a graph of a beam pattern directed to forty five degrees Northeast by an antenna configured according to the invention.

FIG. 6C is a graph of another beam pattern model obtained by steering the beam twenty-two degrees north east upon detection of movement of the mobile subscriber unit.

Figure 6D:
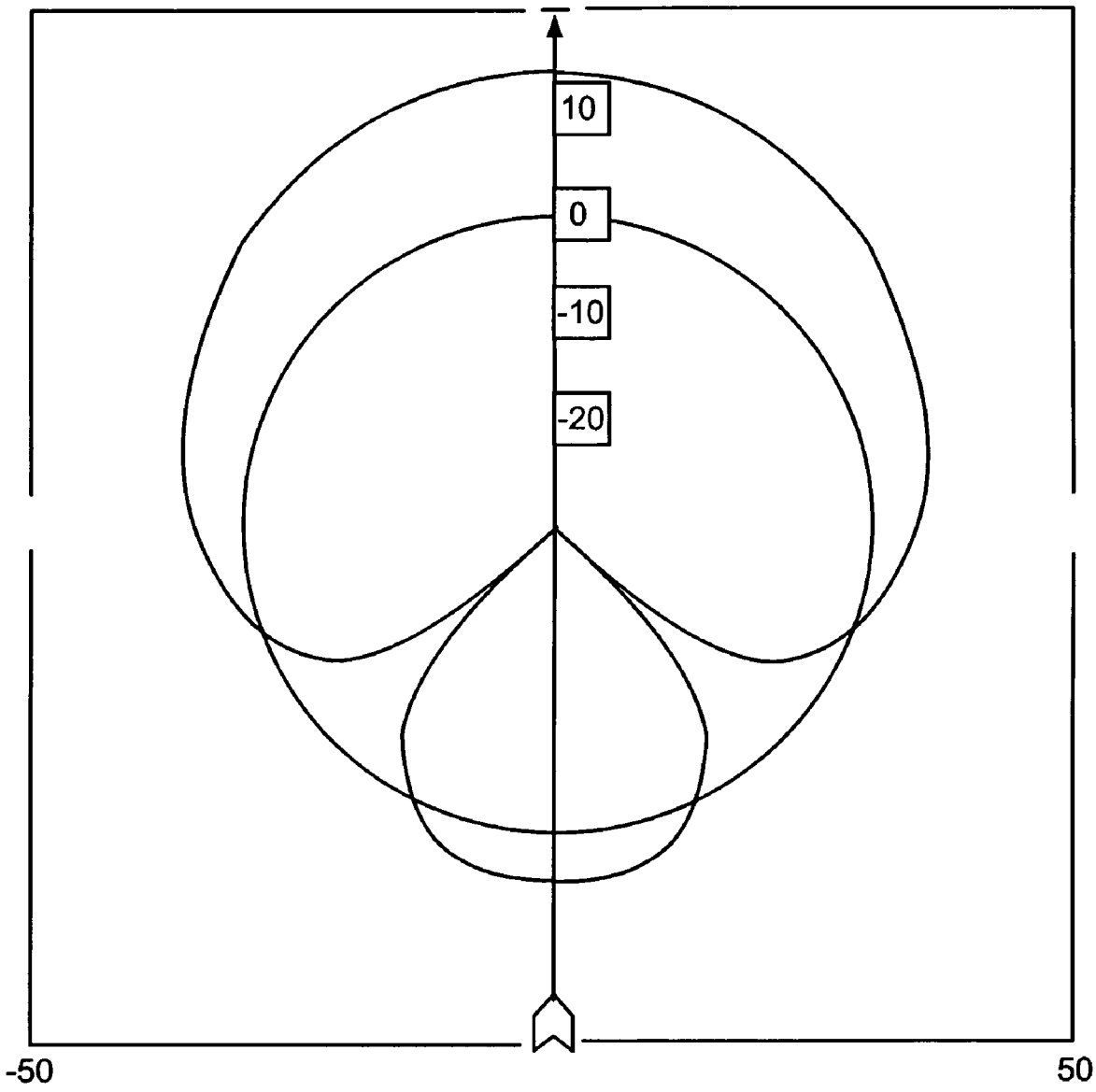
FIG. 6D is a graph of beam strength for an antenna configured according to the invention which shows a 9 decibel increase in gain.

FIG. 6D is a graph of the power gain obtained from the antenna apparatus 100 as compared to the power gain obtained from an omni-directional single element antenna as used in the prior art. As shown, the invention provides a significant increase is the directed power signal by increasing the signal by 9 dB over prior art signal strengths using omnipole antennas.

The antenna apparatus in preferred embodiments of the invention is inexpensive to construct and greatly increases the capacity in a CDMA interference limited system. That is, the number of active subscriber units within a single cell in a CDMA system is limited in part by the number of frequencies available for use and by signal interference limitations that occur as the number of frequencies in use increases. As more frequencies become active within a single cell, interference imposes maximum limitations on the number of users who can effectively communicate with the base station. Intercell interference also contributes as a limiting factor is cell capacity.

Since this invention helps to eliminate interference from adjacent cells and selectively directs transmission and reception of signals from each mobile unit equipped with the invention to and from the base station, an increase in the number of users per cell is realized.

Moreover, the invention reduces the required transmit power for each mobile subscriber unit by providing an extended directed beam towards the base station.

Alternative physical embodiments of the antenna include a four element antenna wherein the three passive antenna elements are positioned at corners of an equilateral triangular plane and are arranged orthogonally and extend outward from that plane. The active antenna element is similarly situated but is located in the center of the triangle.

Figure 7:
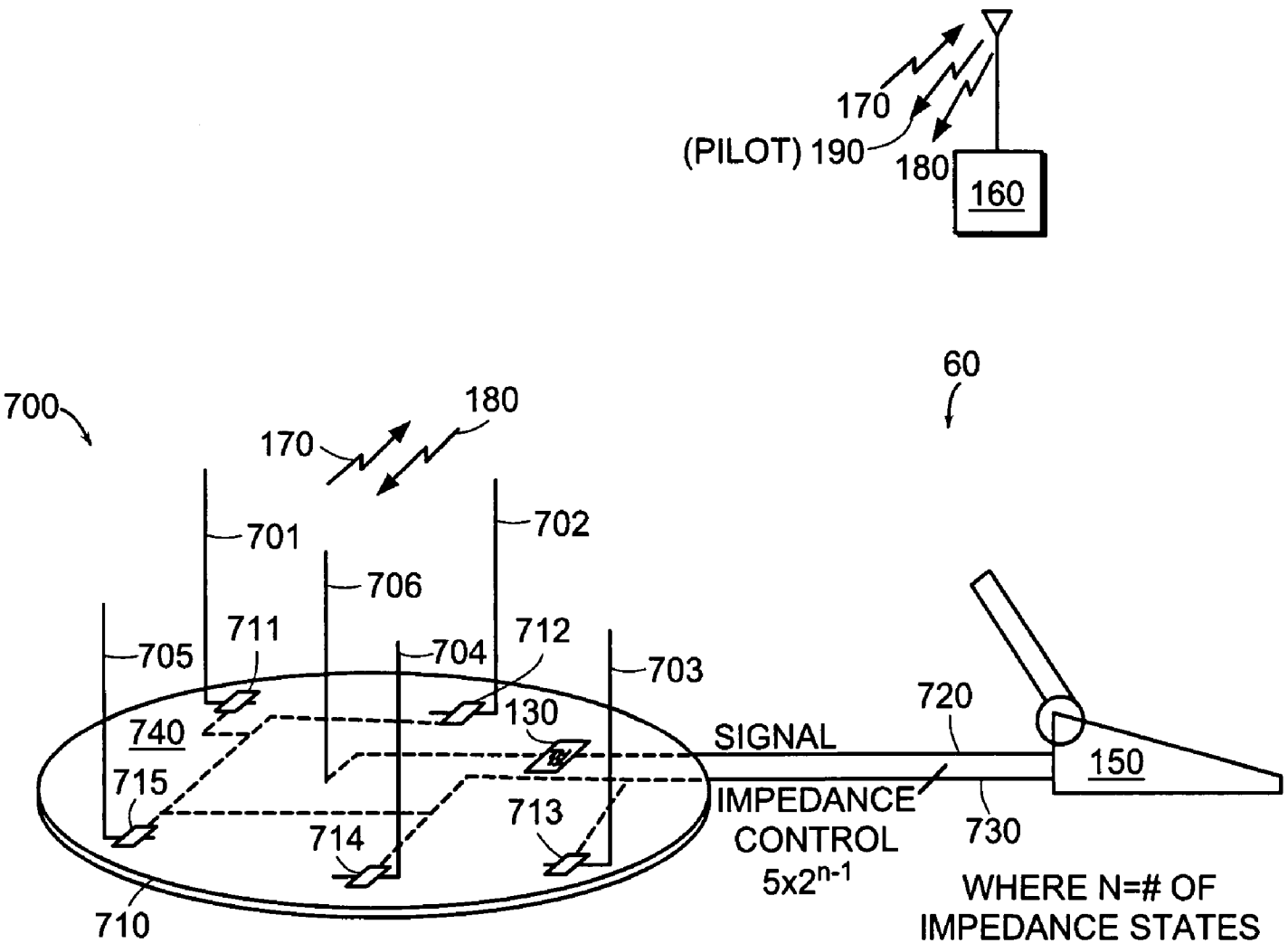
FIG. 7 illustrates an alternative configuration of an antenna apparatus used by the mobile subscriber unit or client station of FIG. 2.

FIG. 7 illustrates a detailed isometric view of a mobile subscriber unit 60 and an associated antenna apparatus 700 configured according to the present invention. The antenna apparatus 700 is an alternative embodiment of the previously discussed antenna apparatus 100 (FIG. 2). In contrast to the earlier presented antenna apparatus 100, this antenna apparatus 700 employs multiple passive antenna elements 701–705 that are electromagnetically coupled (i.e., mutually coupled) to a centrally located active antenna element 706. The passive antenna elements 701–705 re-radiate electromagnetic energy, which affects the direction from/to which the active antenna element 706 receives/transmits RF signals, respectively.

The passive antenna elements 701–705 are selectably operated in one of two modes: reflective mode and transmissive mode. A processor (not shown but described in reference to FIG. 2) provides this control.

In reflective mode, the passive antenna elements 701–705 are effectively elongated by being inductively coupled to ground. In transmissive mode, the passive antenna elements 701–705 are effectively shortened by being capacitively coupled to ground. The direction of a beam steered by the antenna apparatus 700, therefore, can be determined by knowing which passive antenna elements are in reflective mode and which are in transmissive mode. The direction of the beam extends to/from the active antenna element, projecting past the passive antenna elements in transmissive mode and away from the passive antenna elements in reflective mode.

The antenna apparatus 700 includes a platform or housing 710 upon which the five passive antenna elements 701 through 705 and active antenna element 706 are mounted. Within the housing 710, the antenna apparatus 700 includes adjustable impedance components 711 through 715. For an embodiment having multiple active antenna elements 706, the antenna apparatus 700 includes components shown and described in FIG. 2, including a bi-directional summation network or splitter/combiner 120, transceiver 130, and control processor 140, which are all interconnected via bus 135. As illustrated, the antenna apparatus 700 is coupled via the transceiver 130 to the laptop computer 150 (not drawn to scale). The antenna apparatus 700 allows the laptop computer 150 to perform wireless data communications via forward link signals 180 transmitted from base station 160 and reverse link signals 170 transmitted to base station 160.

In a preferred embodiment, each passive antenna element 701 through 705 is disposed on the surface of the housing 710, as illustrated in the figure. In this preferred embodiment, the passive antenna elements 701, 702, 703, 704 and 705 are respectively positioned at locations corresponding to the radial edge of a circle, and the active antenna element 706 is positioned at a location corresponding to the center of the circle. The distance between each passive antenna elements 701 through 705 and the active antenna element 706 is great enough so that the phase relationship between a signal received by more than one element 701 through 706 will be somewhat out of phase with other elements that also receive the same signal, assuming the passive antenna elements 701 through 706 have the same impedance setting, which translates into phase setting, as determined by adjustable impedance components 711 through 715. That is, if the phase setting of each element 701 through 705 were the same, each element 701 through 705 would receive the signal somewhat out of phase with the other elements.

However, according to the operation of the antenna 700 in this invention, the selectable impedance components 711 through 715 are independently adjustable to affect the directionality of signals to be transmitted and/or received to or from the subscriber unit (i.e., laptop computer 150 in this example). By properly adjusting the phase for each passive antenna element 701 through 705 during signal transmission by the active antenna element 706, a composite beam is formed that may be positionally directed towards the base station 160. That is, the optimal phase setting for sending a reverse link signal 170 from the antenna apparatus 700 is a phase setting for each passive antenna element 701 through 705 that re-radiates RF energy to assist in creating a directional reverse link signal. The result is an antenna apparatus 700 which directs a stronger reverse link signal pattern in the direction of the intended receiver base station 160.

The phase settings used for re-radiating RF energy of transmission signals also cause the passive antenna elements 701 to 705 to allow the active antenna element 706 to optimally receive forward link signals 180 that are transmitted from the base station 160. Due to the programmable nature and the independent phase setting of each passive antenna element 701 through 705, only forward link signals 180 arriving from a direction that is more or less in the location of the base station 160 are optimally received. The passive antenna elements 701 through 705 naturally reject other signals that are not transmitted from a similar location as are the forward link signals. In other words, a directional antenna beam is formed by independently adjusting the phase of each passive antenna element 701 through 705.

The selectable impedance components 711 through 715 shift the phase of the reverse link signal in a manner consistent with re-radiating RF energy by an impedance setting associated with that particular selectable impedance component 711 through 715, respectively, as set by an impedance control input 730. In one embodiment, the impedance control input 730 is provided over a number of lines equal to the number of passive antenna elements, five, multiplied by the number of impedance states minus one for each of the selectable impedance components 711–715. For example, if the selectable impedance components 711–715 have two states, then there are five lines. Alternatively, a serial encoding method of the states may be employed to reduce the number of control lines to one, which would then require appropriate decode circuitry to be used on the housing 710.

By shifting the phase of the re-radiated RF energy of the transmitted reverse link signals 170 from each element 701 through 705, certain portions of the transmitted signal 170 will be more in phase with other portions of the transmitted signal 170. In this manner, the portions of signals that are more in phase with each other will combine to form a strong composite beam for the reverse link signals 170. The amount of phase shift provided to each antenna element 101 through 105 through the use of the selectable impedance components 711 through 715, respectively, determines the direction in which the stronger composite beam will be transmitted, as described above in terms of reflectance and transmittance.

The phase settings, provided by the selectable impedance components 711 through 715, used for re-radiating RF signals from each passive antenna element 701 through 705, as noted above, provide a similar physical effect on a forward link frequency signal 180 that is received from the base station 160. That is, as each passive antenna element 701 through 705 re-radiates RF energy of a signal 180 from the base station 160 to the active antenna element 706, the respective received signals will initially be out of phase with each other due to the location of each passive antenna element 701 through 705 upon the housing 710. However, each received signal is phase-adjusted by the selectable impedance components 711 through 715. The adjustment brings each signal in phase with the other re-radiated signals 180. Accordingly, when each signal is received by the active antenna element 706, the composite received signal will be accurate and strong and in the direction of the base station 160.

To optimally set the impedance for each selectable impedance component 711 through 715 in the antenna apparatus 700, the selectable impedance components 711–715 control values are provided by the controller 140 (FIG. 2). Generally, in the preferred embodiment, the controller 140 determines these optimum impedance settings during idle periods when the laptop computer 150 is neither transmitting nor receiving data via the antenna apparatus 700. During this time, a received signal, for example, a forward link pilot signal 190, that is continuously sent from the base station 160 is received on each passive antenna element 701 through 705 and active antenna element 706. That is, during idle periods, the selectable impedance components 711 through 715 are adjusted to optimize reception of the pilot signal 190 from the base station 160, such as by maximizing the received signal energy or other link quality metric.

The processor 140 thus determines an optimal phase setting for each passive antenna element 701 through 705 based on an optimized reception of a current pilot signal 190. The processor 140 then provides and sets the optimal impedance for each selectable impedance component 711 through 715. When the antenna apparatus 700 enters an active mode for transmission or reception of signals between the base station 160 and the laptop 150, the impedance settings of the adjustable impedance components 711 through 715 remain as set during the previous idle time period.

Before a detailed description of phase (i.e., impedance) setting computation as performed by the processor 140 is given, it should again be understood that the principles of the present invention are based in part on the observation that the location of the base station 160 in relation to any one mobile subscriber unit (i.e., laptop 150) is approximately circumferential in nature. That is, if a circle were drawn around a mobile subscriber unit and different locations are assumed to have a minimum of one degree of granularity between any two locations, the base station 160 can be located at any of a number of different possible angular locations. Assuming accuracy to one degree, for example, there are 360 different possible phase setting combinations that exist for an antenna 100. Each phase setting combination can be thought of as a set of five impedance values, one for each selectable impedance component 711–715 electrically connected to respective passive antenna elements 701 through 705.

There are, in general, at least two different approaches to finding the optimized impedance values. In the first approach, the controller 140 performs a type of optimized search in which all possible impedance setting combinations are tried. For each impedance setting (in this case, for each one of the 360 angular settings), five precalculated impedance values are read, such as from memory storage locations in the controller 140, and then applied to the respective selectable impedance components 711 through 715. The response of the receiver 130 is then detected by the controller 140. After testing all possible angles, the one having the best receiver response, such as measured by maximum signal to noise ratio (e.g., the ratio of energy per bit, Eb, or energy per chip, Ec, to total interference, Io), is used.

In a second approach, each impedance value is individually determined by allowing it to vary while the other impedance values are held constant. This perturbational approach iteratively arrives at an optimum value for each of the five impedance settings.

Figure 8A:
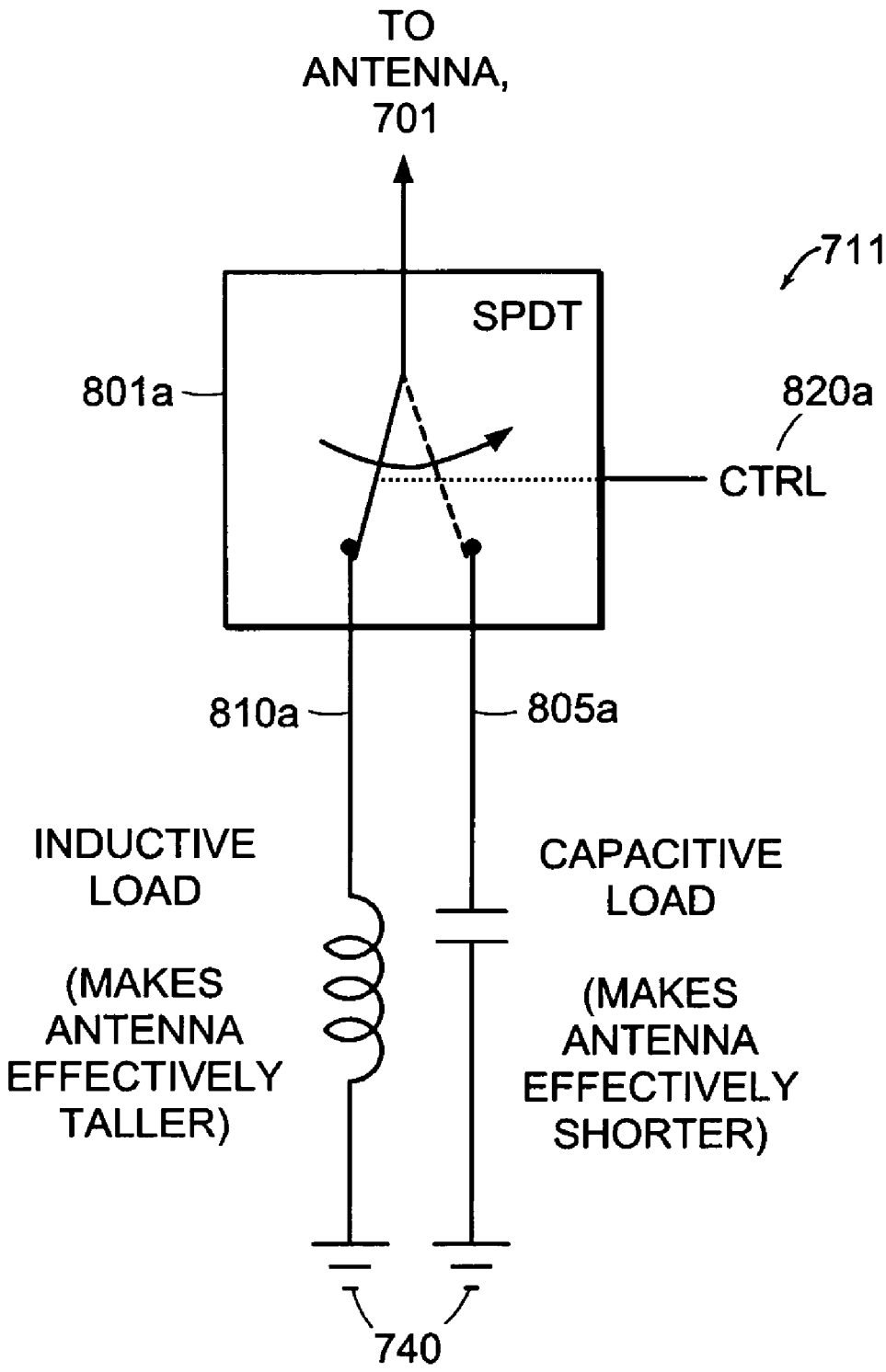
FIG. 8A is a schematic diagram of a selectable impedance component employed by the antenna apparatus of FIG. 7.

FIG. 8A is an embodiment of the selective impedance component 711 coupled to its respective passive antenna element 701. The selectable impedance component 711 includes a switch 801*a*, capacitive load 805*a*, and inductive load 810*a*. Both the capacitive load 805*a* and inductive load 810*a* are connected to the ground plane 740, as shown.

The switch 801*a* is a single-pole, double-throw switch controlled by a signal on a control line 820*a*. When the signal on the control line 820*a* is in a first state (e.g., digital "one"), the switch 801*a* electrically couples the passive antenna element 701 to the capacitive load 805*a*. The capacitive load makes the passive antenna element 701 effectively shorter. When the signal on the control line 820*a* is in a second state (e.g., digital "zero"), the switch 801*a* electrically couples the passive antenna element 701 to the inductive load 810*a*, which makes the passive antenna element 701 effectively taller, and, therefore, reflective.

Figure 8B:
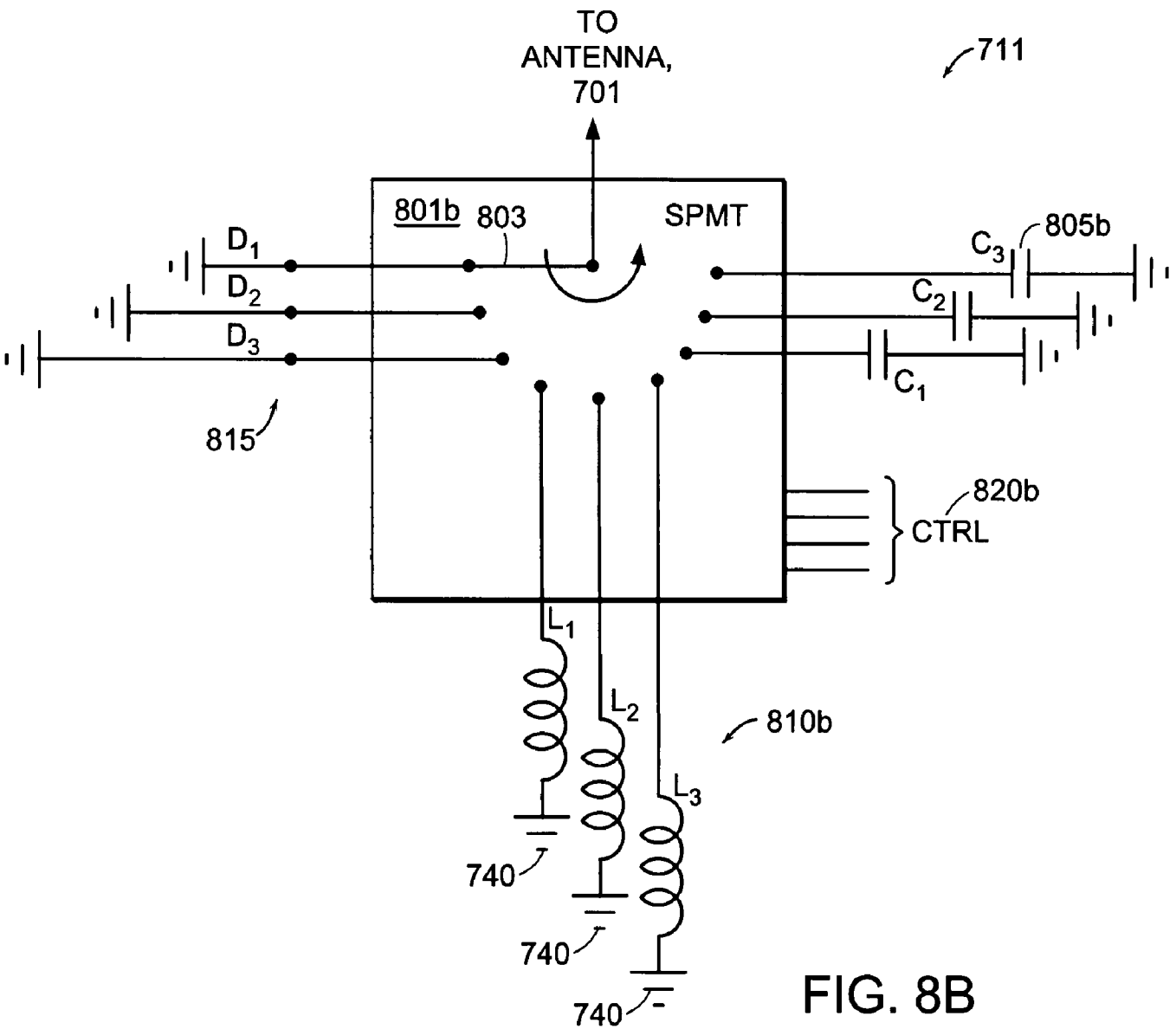
FIG. 8B is a schematic diagram of an alternative selectable impedance component used by the antenna apparatus of FIG. 7.

FIG. 8B is an alternative embodiment of the selectable impedance component 711 coupled to its respective passive antenna element 701. In this embodiment, the selectable impedance component 711 includes a switch 801*b* connected to several different, discrete, impedance components types each having multiple pre-determined values.

The switch 801*b* is a single-pole, multiple-throw switch controlled by binary-coded decimal (BCD) signals on four control lines 820*b*. The signal on the four control lines 820*b* command a pole 803 of the switch 801*b* to electrically connect the passive antenna element 701 to 1-of-16 different impedance components. As shown, there are only nine impedance components provided for coupling to the passive antenna element 701.

The selectable impedance components include capacitive elements 805*b*, inductive elements 810*b*, and delay line elements 815. Each of the impedance components is electrically disposed between the switch 801*b* and the ground plane 740.

In this embodiment, the capacitive elements 805*b* include three capacitors: C1, C2, and C3. Each capacitor has a different capacitance to cause the passive antenna element 701 to have a different transmissibility when connected to the passive antenna element 701. For example, the capacitive elements 805*b* may be of an order of magnitude a part in capacitance value from one another.

Similarly, the inductive elements 810*b* include three inductors: L1, L2, and L3. The inductive elements 810*b* may have inductance values an order of magnitude apart from one another to provide different reflectivities for the passive antenna element 701 when connected to the passive element 701.

Similarly, the delay line elements 815 include three different lines: D1, D2, and D3. The delay line elements 815 may be sized to create a phase shift of the signal re-radiated by the passive antenna element 701 in, say, thirty degree increments.

In an alternative embodiment, the switch 801*b* may be a double-pole, double-throw switch to provide different combinations of impedances coupled to the passive antenna element 701 to provide various combinations of impedances. In this way, the passive antenna element 701 can be used to re-radiate RF energy to the active antenna element 706 with various phase angles to allow the antenna apparatus 700 to provide a directive beam at various angles. In one case, the controller 140 (FIG. 2) (i) selects a first impedance combination to provide a receive beam at one angle by the antenna apparatus 700 and (ii) provides a second impedance component combination to generate a transmit beam at a second angle by the antenna apparatus 700. It should be understood that choosing combinations of selectable impedance components 805*b*, 810*b*, and 815 are made in a similar manner at the other selectable impedance components 712–715 coupled to the other passive antenna elements 702–705, respectively.

Alternative technology embodiments of the switch 801*b* are possible. For example, the switch 801*b* may be composed of multiple single-pole, single-throw switches in various combinations. The switch 801*b* may also be composed of solid-state switches, such as GaAs switches or pin diodes and controlled in a typical manner. Such a switch may conceivably include selectable impedance component characteristics to eliminate separate impedance or delay line components. Another embodiment includes Micro-Electro Machined Switches (MEMS), which act as a mechanical switch, but have very fast response times and an extremely small profile.

Figure 8C:
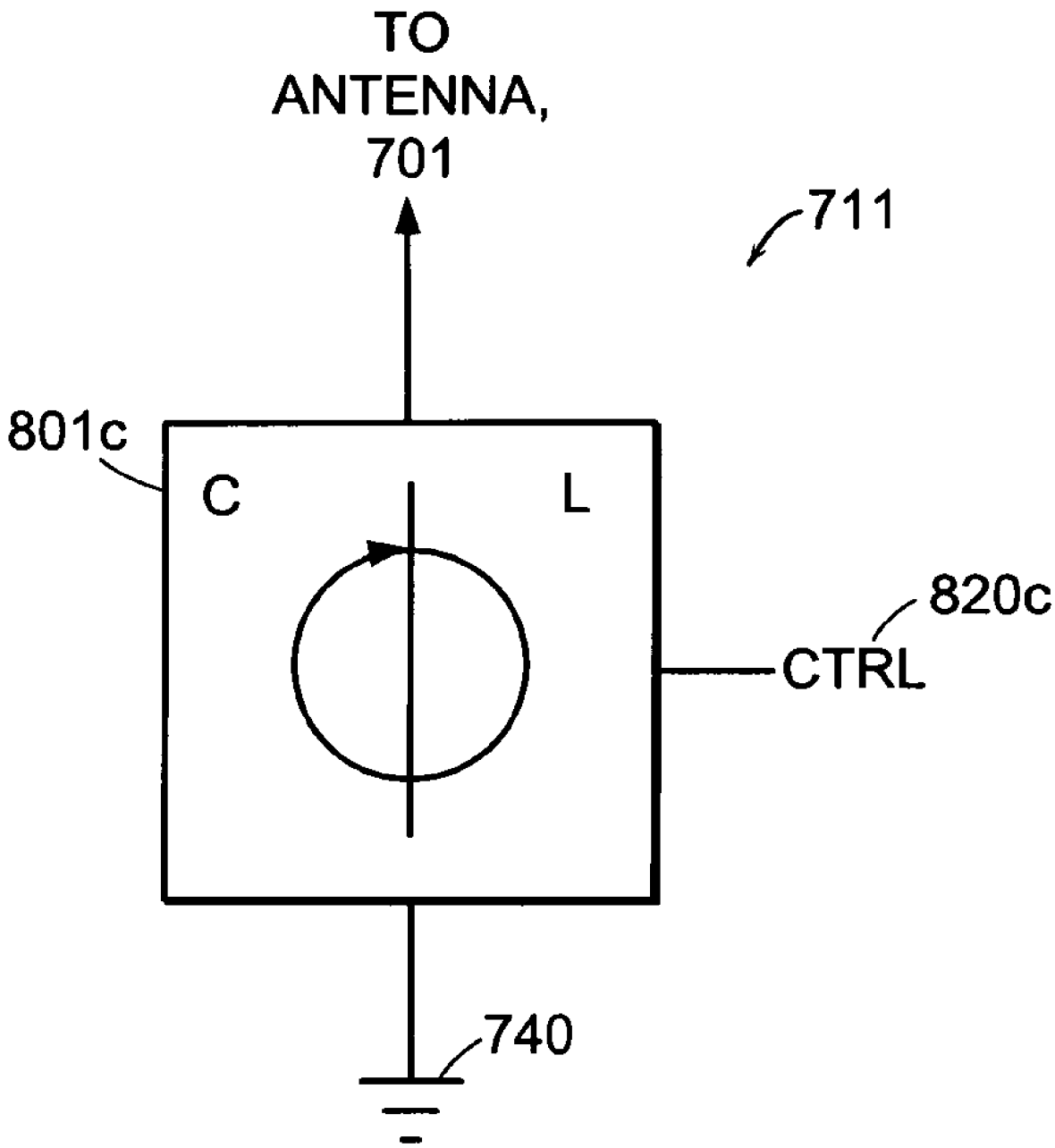
FIG. 8C is a schematic diagram of yet another alternative selectable impedance component used by the antenna apparatus of FIG. 7.

FIG. 8C is yet another alternative embodiment of the selectable impedance component 711 connected to the passive antenna element 701. In this embodiment, the selectable impedance component 711 is composed of a varactor 801*c*. The varactor 801*c* is controlled by an analog signal on a control line 820*c*. In an alternative embodiment, the varactor 801*c* is controlled by BCD signals on digital control lines. The varactor 801*c* is connected to the ground plane 740, as shown. The varactor allows analog-type phase shift selectability to be applied to the passive antenna element 701. It should be understood that each of the passive antenna elements 701–705, in this embodiment, are connected to respective varactors to provide virtually infinite phase shifting via the virtually infinite selectable impedance values of the varactors. In this way, the antenna apparatus 700 can be made to provide directive beams in virtually any direction; for example, in one degree increments in a three hundred sixty degree circle.

Figure 9A:
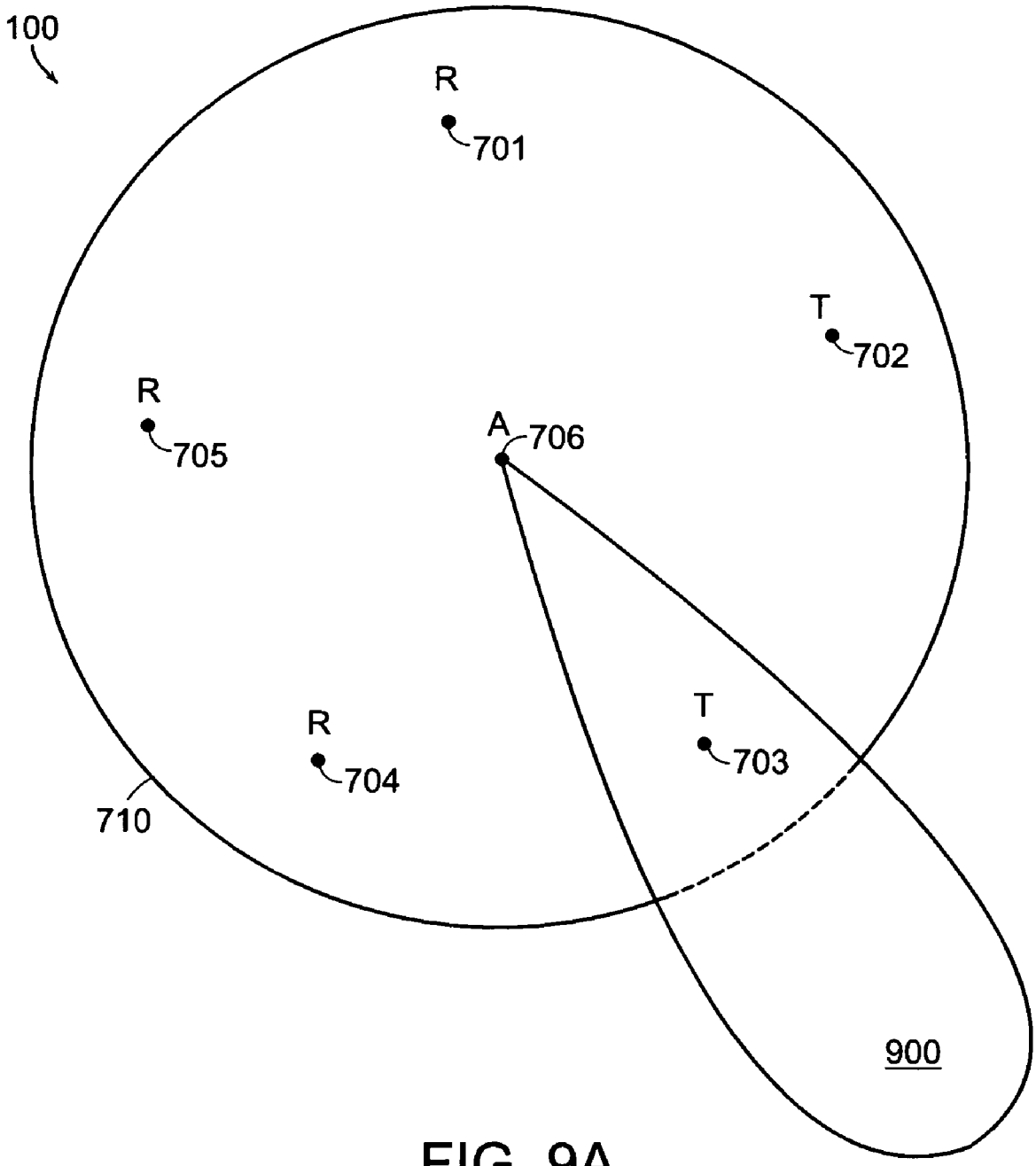
FIG. 9A is a top view of the antenna apparatus of FIG. 7 and a beam pattern generated therefrom.

FIG. 9A is an example of a scan angle of a directive beam 900 that the antenna apparatus 700 is capable of forming using one of the embodiments of the selectable impedance components 711 of FIGS. 8A–8C or equivalents thereof. As shown, the active antenna element 706 is surrounded by the five passive antenna elements 701–705. Each of the antenna elements 701–706 mechanically extends from the housing 710.

In this configuration, two passive antenna elements 701, 705 are in the reflective mode, and the other passive antenna elements 702–704 are in the transmissive mode. The directive beam 900 resulting from this configuration extends from the active antenna element directly over the central of the three passive antenna elements 702–704 in the transmissive mode. It is assumed that the passive antenna elements 701, 705 in reflective mode are electrically connected to selectable impedance components having the same inductance values, and the passive antenna elements 702–704 in the transmissive mode are electrically connected to selectable impedance components having the same capacitance values. It should be understood that selecting different angles of the directive beam 900 can be provided by different re-radiating phase angles by the passive antenna elements 701–705, such as selecting of one of the passive antenna elements 702–704 in the transmissive mode to have a different capacitance value than the other two.

Figure 9B:
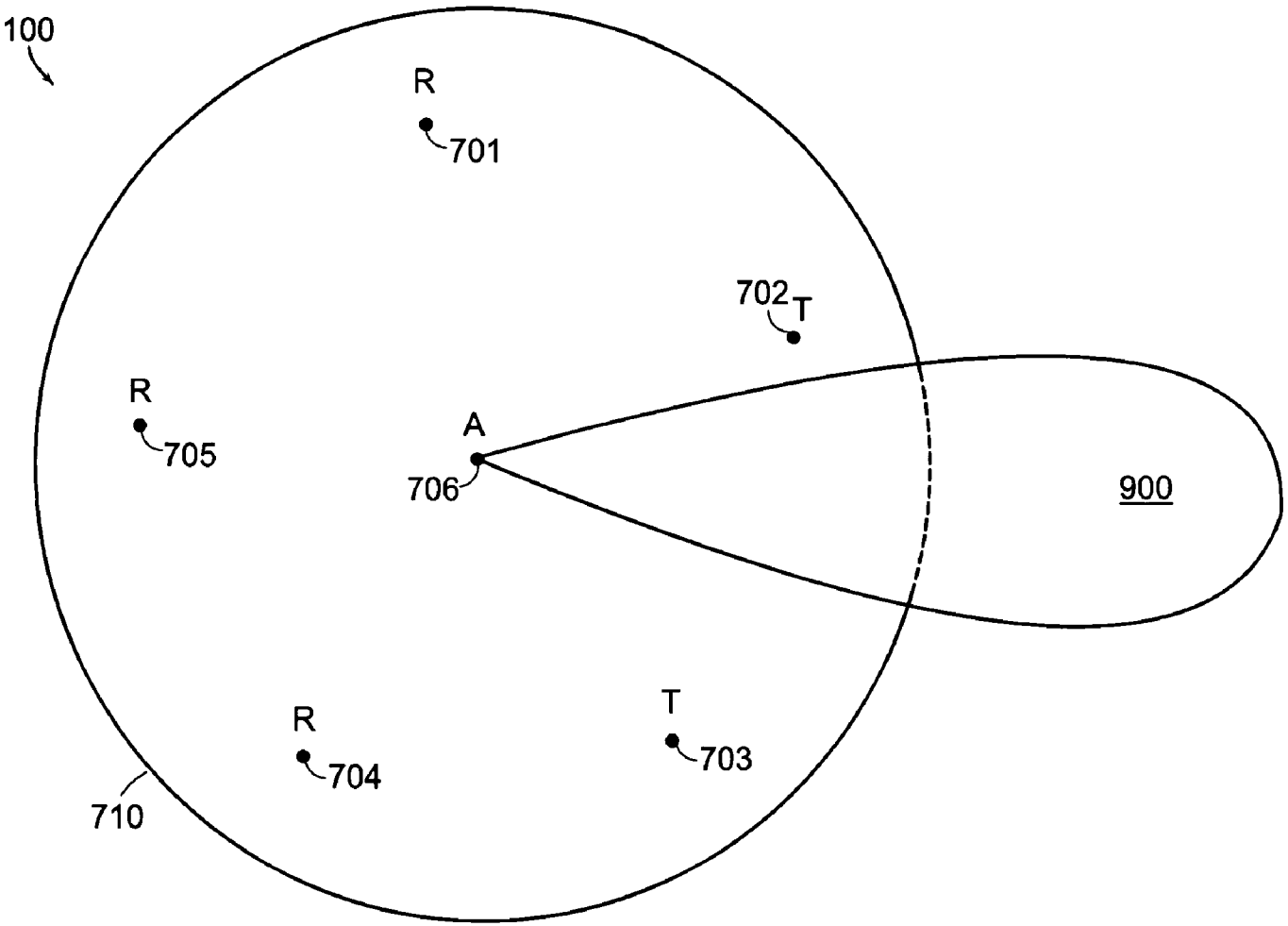
FIG. 9B is a top view of the antenna apparatus of FIG. 7 and another beam pattern generated therefrom.

FIG. 9B is an example of the antenna apparatus 700 producing the directive beam 900 at a different angle. Here, there are three passive antenna elements 701, 704, 705 set in reflective mode by the controller 140 (FIG. 2). The other two passive antenna elements 702, 703 are set in transmissive mode. Thus, the active antenna element 706, in combination with the passive antenna elements 701–705. re-radiating RF signals, directs beams—both receive (forward link) and transmit (receive link) beams—steers the directive beam 900 in the direction shown. As described above, the directive beam 900 may be angled slightly differently based on the configuration of the respective selectable impedance components 711–715. It should be understood that the directive beam 900 may be steered in different angles for transmit and receive beams.

Figure 10:
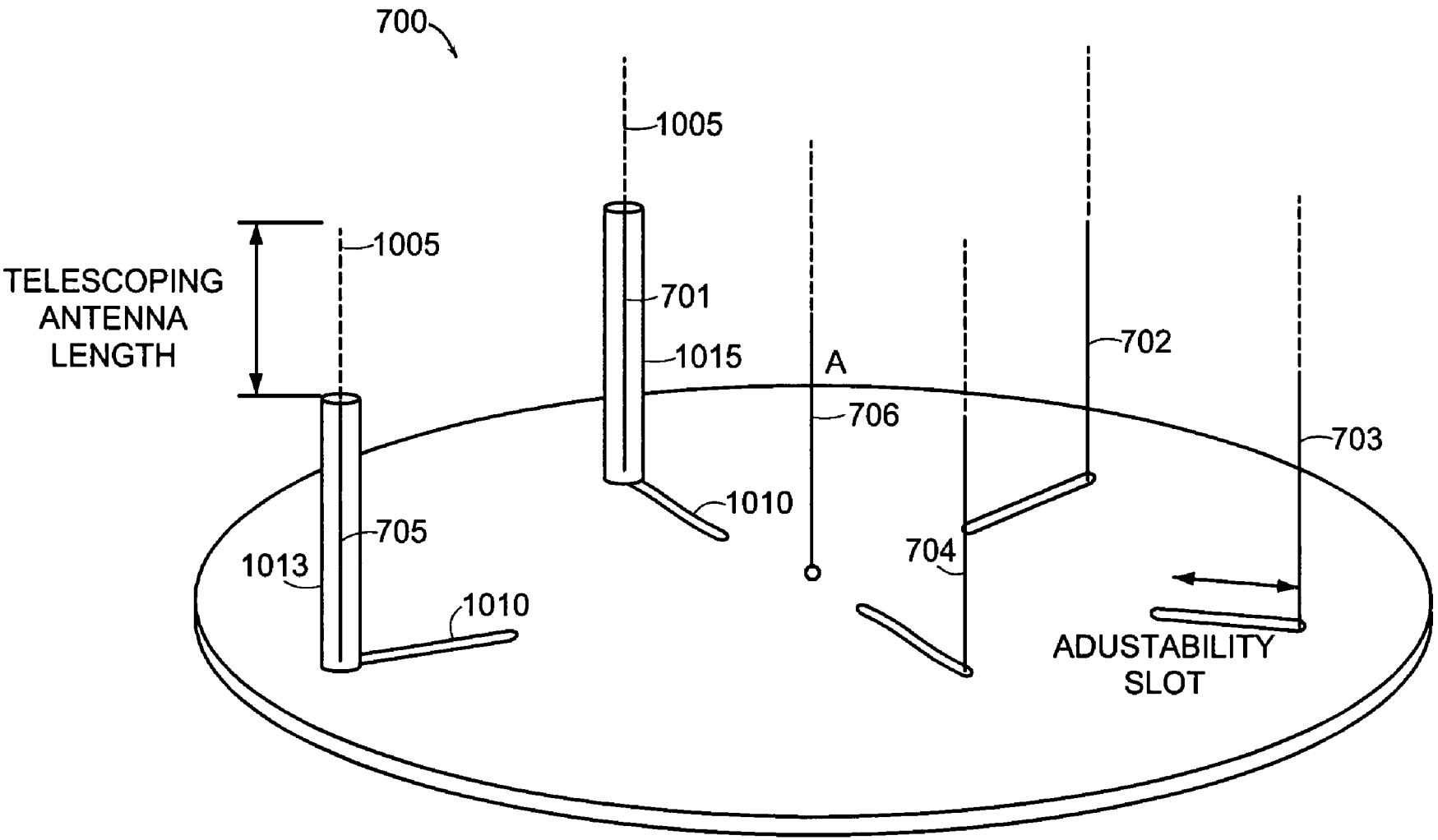
FIG. 10 is an isometric view of the antenna apparatus of FIG. 7 in an embodiment having manual adjustments to change the beam pattern generated therefrom.

FIG. 10 is an illustration of the antenna apparatus 700 having various mechanical adjustments for changing the antenna characteristics. For example, the antenna elements 701–706 may be telescoping to accommodate different RF signal wavelengths to work in various communication networks, such as Personal Communications Systems (PCS) at 1.9 GHz and Wireless Communication System (WCS) at 2.4 GHz (802.11b or 802.11g) or 5.2 GHz (802.11a). As shown, the active and passive antenna elements can extend to lengths shown by dashed lines 1005.

Another mechanical adjustment that can be made to the passive antenna elements is through the use of adjustability slots 1010. The adjustability slots 1010 allows the passive antenna elements 701–705 to be manually moved radially inward and outward from the active antenna element 706. Alternatively, the adjustability slot could be a series of threaded screw mounts to which the passive antenna elements 701–705 are capable of being connected. In addition, multiple rings of passive antenna elements, optionally staggered, could be provided, though efficiency of the mutual coupling outwardly decreases. By varying the spacing between the passive elements 701–705 and central active antenna element 706, the angle of the beam produced by the antenna apparatus 700 can be changed as desired.

Yet another manual adjustment that can be made to the passive antenna elements 701–705 is the addition of a tubular coupling that can be placed on top of the passive elements 701–705. As shown, tubular couplings 1015 are placed on top of passive antenna elements 701 and 705. The tubular couplings 1015 increase the diameter of the passive antenna elements, making the passive antenna elements re-radiate differently from the passive antenna elements without the tubular couplings 1015. It should be understood that the tubular couplings 1015 may, in fact, be thicker, replaceable, passive antenna elements. In either case, the directive beam 900 (FIG. 9A) is changed in angle as a result of the increased radius of the passive elements 701, 705.

It should also be understood that the manual adjustments (i.e., 1005, 1010, 1015) can be (i) combined in various ways and applied to only subsets of the passive antenna elements 701–705 and (ii) combined with the electrical selectable impedance components 711–715 in a variety of configurations. Both combinations produce various beam patterns and angles by the antenna apparatus 700. Instructions for making such manual adjustments may be provided via a display on the computer screen of the computer 150 (FIG. 7).

Figure 11:
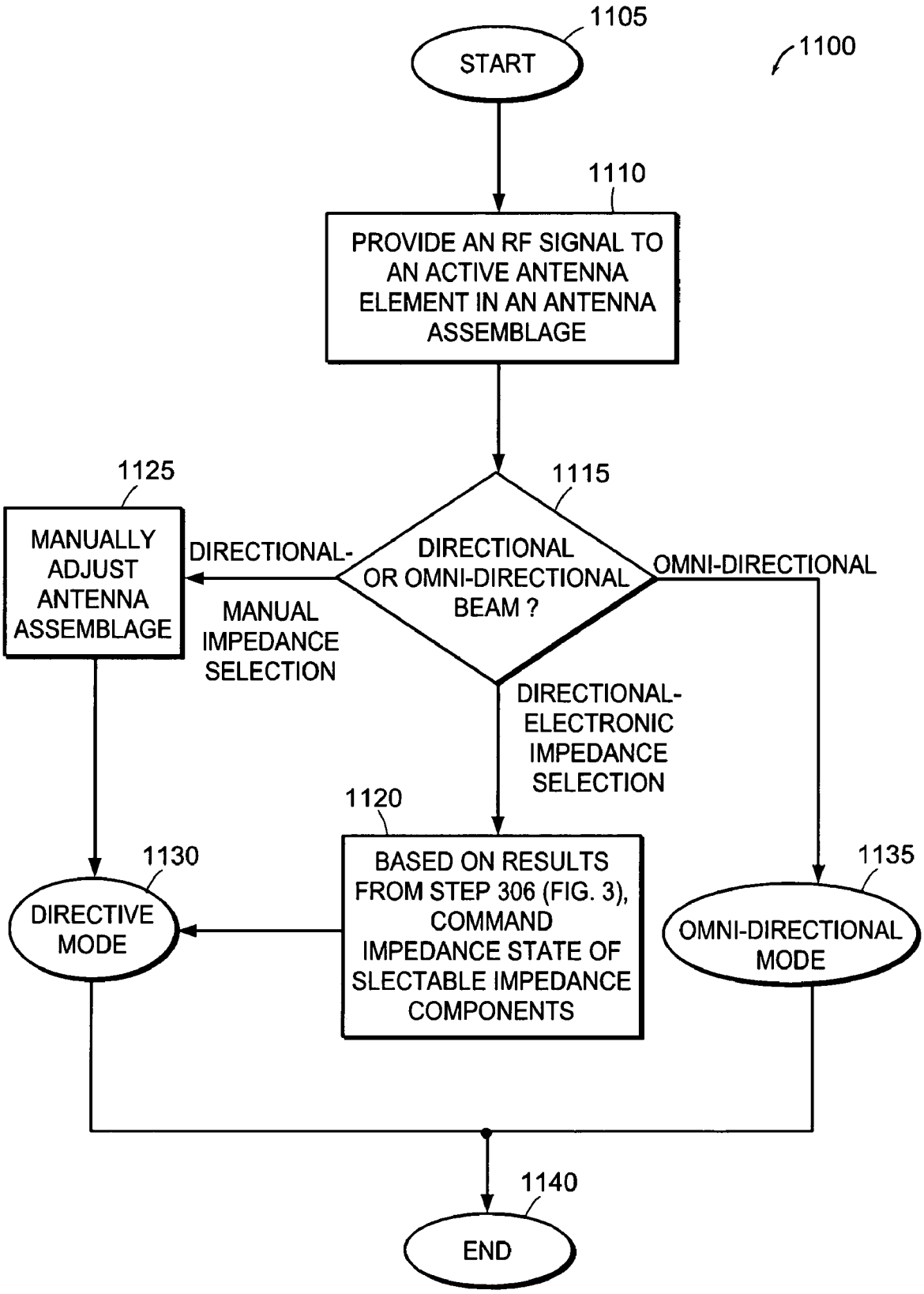
FIG. 11 is a flow diagram of an embodiment of a process used by the subscriber unit or client station and/or antenna apparatus of FIG. 7.

FIG. 11 is a flow diagram of an embodiment of a process for using the antenna apparatus 700. The process 1100 starts in step 1105. In step 1110, the process provides an RF signal to (either transmit or receive) the active antenna element 706 in the antenna assemblage of the antenna apparatus 700. In step 1115, the process 1100 determines whether the beam produced by the antenna apparatus 700 is to be directional (e.g., directive beam 900, FIG. 9A) or omni-directional. If directional, then, for electronic impedance selection, the process 1100 continues in step 1120. Based on results from step 306 (FIG. 3) in which the best setting of impedances is determined to produce the best phase angle of the antenna apparatus 700 based on a measured pilot signal metric, the process 1100 programs the impedances of selectable impedance components 711–715, as described in reference to FIGS. 8A–8C.

If a directional beam is to be generated and manual impedance selection is to be performed, the process 1100 continues to step 1125 for a user of the subscriber unit to manually adjust the antenna assemblage of the antenna apparatus 700. In this case, again, the processor 140 (FIG. 2) may instruct the user to apply a given mechanical configuration of the antenna apparatus 700 via a message displayed on the computer screen of the portable computer 150. Following the manual adjustment of the antenna assemblage in step 1125, the process 1100 continues in step 1130.

If, in step 1115, the process determines that an omni-directional beam pattern is desired, then, in step 1135, omni-directional mode is provided. For the antenna apparatus 700 to provide omni-directional mode, the passive antenna elements 701–705 are coupled to respective selectable impedance components 711–715 having essentially the same capacitance values so that the active antenna element 706 can transmit and receive signals "over" the passive antenna elements 706. Alternatively, a mechanical configuration providing omni-directional mode may be provided by the user, where, for example the active antenna element 706 is telescoped upward to provide an antenna element sufficiently taller than the passive antenna elements 701–705. The process 1100 ends in step 1140.

Figure 12:
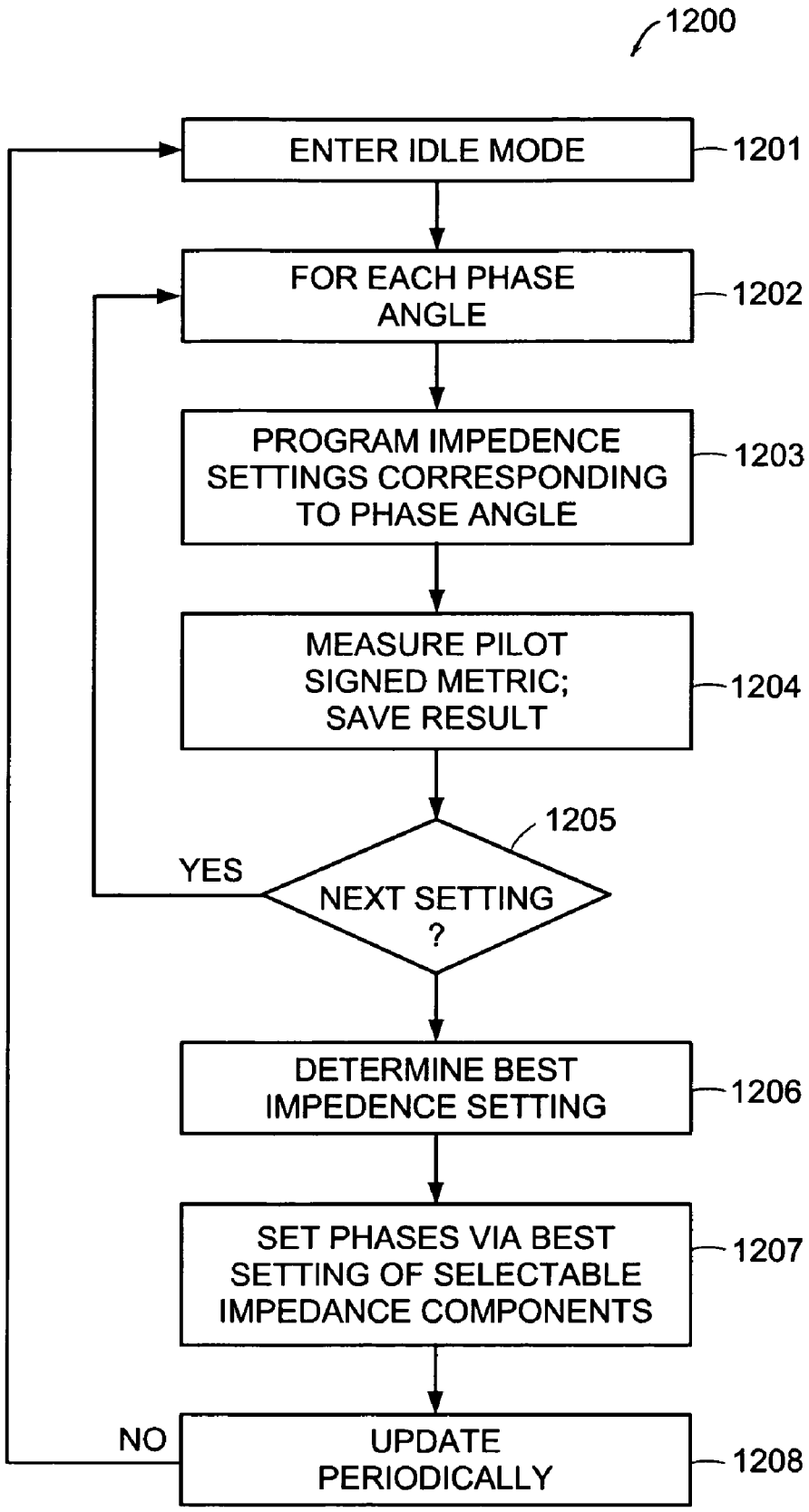
FIG. 12 is a flow chart of the processing steps performed to optimally set the selectable impedance component associated with each passive antenna element in the antenna apparatus of FIG. 7.

FIG. 12 shows steps 1201 through 1206, which parallel steps 301 through 306 (FIG. 3), performed by the controller 140 according to one embodiment of the invention. In order to determine the optimal impedance settings for selectable impedance components 711 through 715 by the first "search" method, steps 1201 through 1206 are performed during idle periods of data reception or transmission, such as when a pilot signal 190 is being transmitted by the base station 160.

In step 1201, the controller 140 determines that the idle mode has been entered, such as by detecting certain forward link signals 180. Step 1202 then begins a loop that will execute once for each possible angle or location at which the base station 160 may be located. In the preferred embodiment, this loop is executed 360 times. Step 1203 then programs each selectable impedance component 711 through 715 with an impedance setting corresponding to the first location (i.e., angle 0) setting. The impedance settings may, for example, be precalculated and stored in a table, with five selectable impedance component settings for each possible angle corresponding to the five elements of the array. In other words, step 1203 programs impedance settings for a first angle, which may be conceptualized as angle 0 in a 360 degree circle surrounding the mobile subscriber unit 60. Step 1204 then measures the received pilot signal 190, as received by the active antenna element 706. The measurement in step 1204 reflects, in part, how well each passive antenna element 701 through 705 re-radiated the received pilot signal 190 based upon the current set of programmed impedance settings applied in step 1203. Step 1264 saves the measurement as a received signal metric value. The metric may, for example, be a link quality metric as bit error rate or noise energy level per chip (Ec/No).

Step 1205 then returns processing to step 1202 to program the selectable impedance components for the next set of impedance settings. Steps 1202 through 1205 repeat until all 360 sets of phase settings have been programmed into selectable impedance components 711 through 715 (step 1203) and a measurement has been taken of the received pilot signal 190 for each of these settings (step 1204). After step 1205 determines there are no more sets of impedance settings, step 1206 determines the best set of impedance settings, as determined by which settings produced the strongest receive signal metric value. Step 1207 then programs the selectable impedance components 711 through 715 with the set of impedance settings that was determined to produce this best result.

During long periods of idle time, step 1208 is executed, which repeats the process periodically. Step 1208 accounts for the fact that the antenna apparatus 700 might be moved and re-oriented during idle periods, thus affecting the direction and orientation of the base station in relation to the antenna apparatus 700.

In addition, the antenna apparatus 700 may be optimized during transmission. In this manner, steps 1201 through 1208 continuously update and set optimal impedance settings for each passive antenna element 701 through 705. It should be understood that a second process for setting phases of a phased array antenna (e.g., antenna elements 101–105, FIG. 2), should the central active antenna 706 be configured as so, could be performed in a similar manner to optimize phase settings of those antenna elements.

Figure 13:
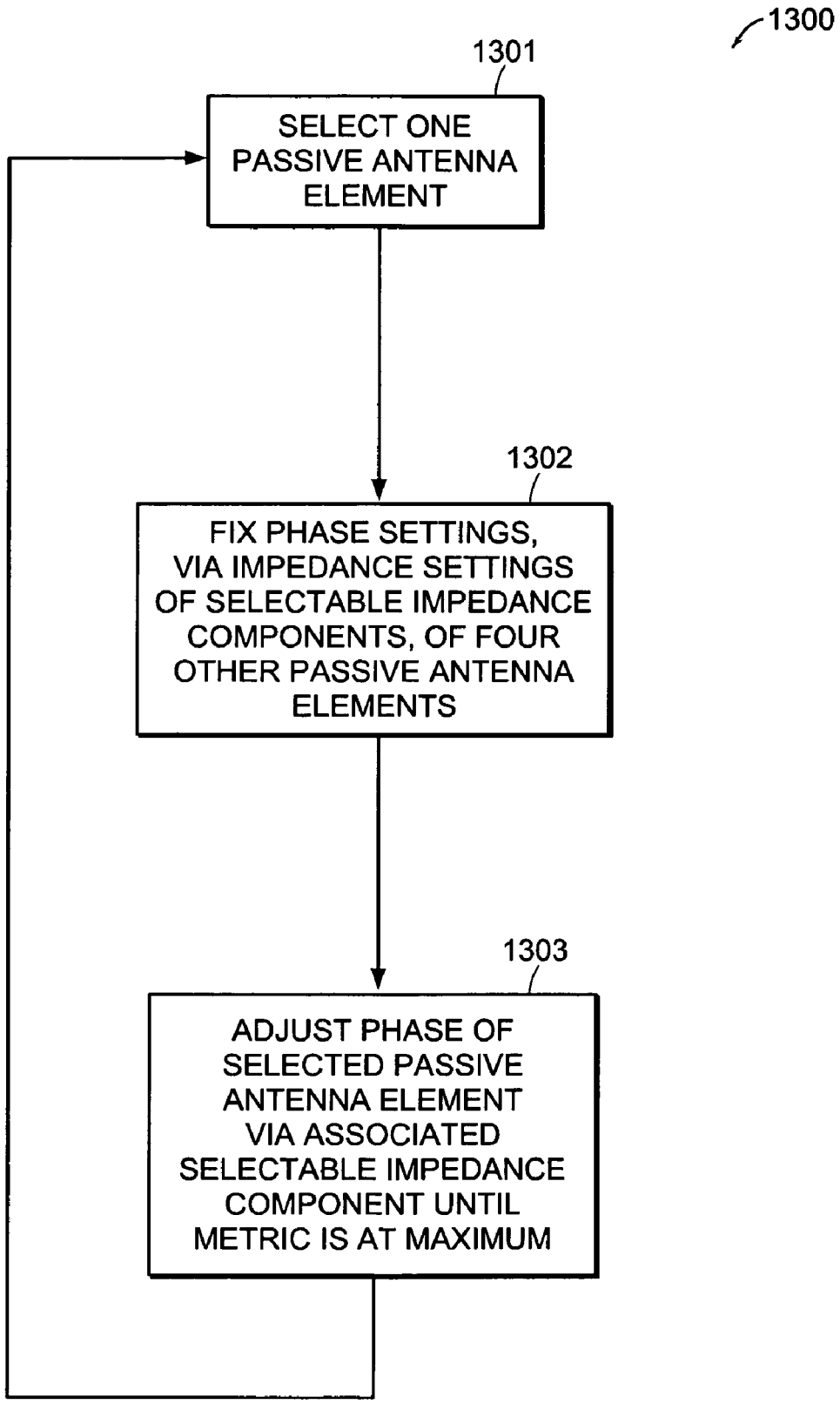
FIG. 13 is a flow chart of steps performed by a perturbational algorithm to optimally determine the impedance setting of the selectable impedance component associated with each passive antenna element in the antenna apparatus of FIG. 7.

FIG. 13 shows processing steps for an alternative method for determining the optimal impedance setting of passive antenna elements 701 through 705 using a perturbational algorithm. Generally, this method uses the perturbational algorithm to determine impedance settings in the form of weights for each passive antenna element 701 through 705.

In step 1301, one of the passive antenna elements 701 through 705 is selected. In step 1302, the phase settings of the four remaining passive antenna elements, via the respective selectable impedance components not selected in step 1301, are fixed in value. Step 1303 then varies the impedance setting of the selectable impedance component associated with the non-fixed passive antenna element selected in step 1301 until the setting that maximizes the pilot signal metric is determined. Then, the process repeats by returning to step 1301, where the previously selected passive antenna element is fixed to this optimum phase and the impedance setting corresponding to one of the other passive antenna elements is varied. The process continues until each passive antenna element is configured with an optimal setting. As the process iterates, the impedance settings of each selectable impedance component, providing phase adjustment for an associated passive antenna element, converge to an optimum setting.

Figure 14:
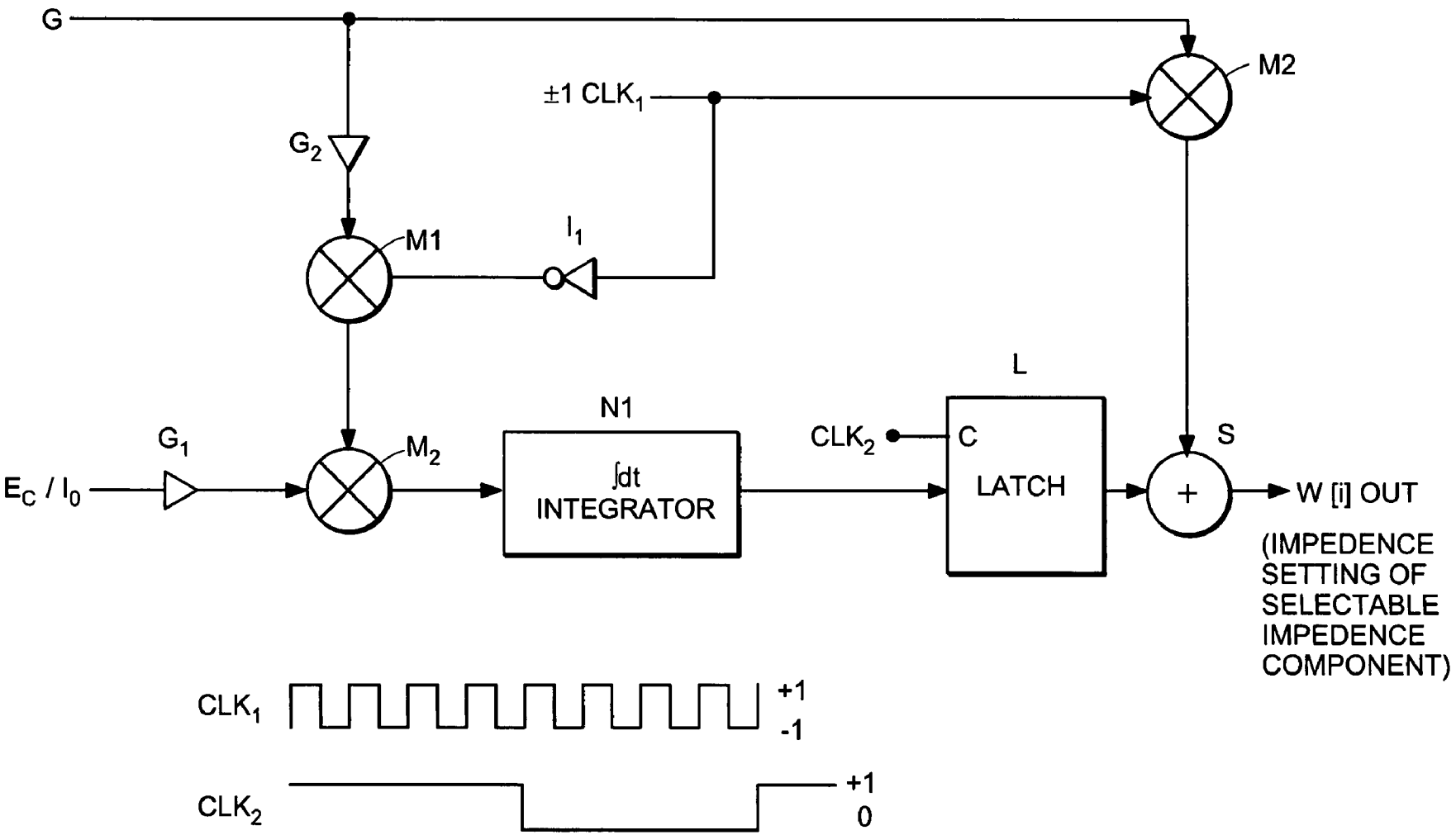
FIG. 14 illustrates a flow diagram for a perturbational computational algorithm for computing the impedance weights to be assigned to each selectable impedance component coupled to each passive antenna element.

FIG. 14 illustrates a more detailed flow diagram for implementing a perturbational algorithm to determine optimal impedance settings for each passive antenna element. The flow diagram in FIG. 5 may be used in place of the processing steps performed by the controller 140 in FIG. 12.

The algorithm fixes a value for four of the five unknown, optimum impedance settings (i.e., weights) W[i], e.g. W[2] through W[5]. The algorithm perturbs the system and observes the response, adapting to find the optimum value for the unfixed impedance value, e.g. W[1]. The measured link quality metric, in this case Ec/Io, is fed to a first gain block G1. Again input G is fed to a second gain block G2. A first fast "clock" date value, CLK1, which alternates from a value of "1" to a value of "−1" is inverted by I1 and fed to a first multiplier M1. The other input of multiplier M1 is fed by the gain block G2.

The output of M1 is fed to a second multiplier M2 together with the output of G1. An integrator N1 measures an average level and provides this to the latch L. A slow clock CLK2, typically alternating at a rate which varies between "1 " and "0" and is much slower than CLK1, by at least 100 times, drives the latch "clock" C. The output of the latch L is summed by summation block S with the non-inverted output of M2. The result, W[i], is a value which tends to seek a localized minima of the function.

The process shown in FIG. 14 is then repeated by setting the first unfixed impedance value W[1] to the derived value, setting W[3] to W[5] to a fixed value and letting W[2] be the output of this process. The process continues to find optimum values for each of the five unknown impedance values.

Alternatively, instead of varying an impedance assigned to each passive antenna element 701 through 705, the impedance setting corresponding to each passive antenna element can be stored in a table of vectors, each vector having assignments corresponding to the five passive antenna elements 701 through 705. The five values in each vector can be computed based upon the angle of arrival of the received pilot signal. That is, the impedance values for each selectable impedance component corresponding to each passive antenna element are set according to the direction in which the base station is located in relation to the mobile subscriber unit. The angle of arrival can be used as a value to lookup the proper vector of weights (and/or impedance settings) in the table. By using a table with vectors, only the single angle of arrival calculation needs to be performed to properly set the impedance settings corresponding to each passive antenna element 701 through 705.

Figure 15:
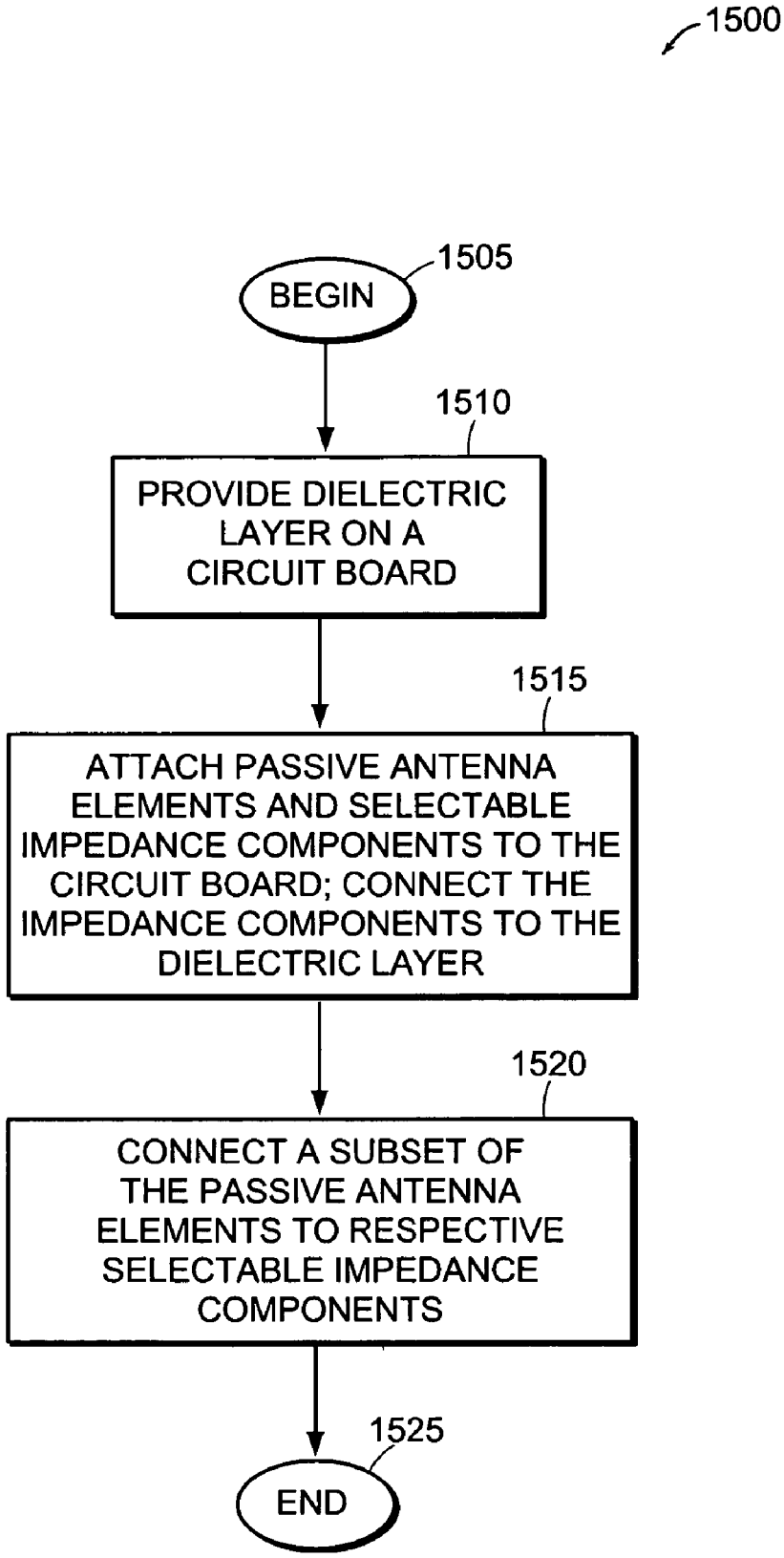
FIG. 15 illustrates a flow diagram of an embodiment of a method of manufacturing the antenna apparatus of FIG. 7.

FIG. 15 is a flow graph diagram of an embodiment of a process for manufacturing the antenna apparatus 700. Because the antenna apparatus 700 is designed having a simplified mechanical layout and assembly in that it requires only a single layer on a circuit board (i.e., ground plane layer), the manufacturing process 1500 is accordingly simple. The manufacturing process 1500 begins in step 1505. In step 1510, a dielectric layer is provided on, for example, a circuit board composed of FR4 material. In step 1515, the manufacturing process 1500 includes attaching passive antenna elements and selectable impedance components to the circuit board. The selectable impedance components are then connected to the dielectric layer. In step 1520, the manufacturing process 1500 connects a subset of the passive antenna elements 701–705 to respective selectable impedance components 711–715. In step 1525, the manufacturing process 1500 ends.

The manufacturing process 1500 can be modified in various ways. For example, in step 1515, the manufacturing process 1500 can include attaching at least one active antenna element to the circuit board. Further, multiple types of selectable impedance components can be connected to the circuit board. It should be understood that various types of selectable impedance components can be connected to the circuit board; for example, the selectable impedance components may be printed on the circuit board on the same layer as the ground plane 740, attached as discrete elements to the circuit board, or wave soldered to the circuit board in the form of a "chip" that includes discrete components (i.e. inductors, capacitors, delay lines, varactors, etc.).

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. For example, there can be alternative mechanisms to determining the proper phase for each passive element, such as storing impedance setting values in a linked list or a database instead of a table. Moreover, those skilled in the art of radio frequency measurement understand there are various ways to detect the origination of a signal, such as the received pilot signal. These mechanisms for determining the location of signal origination are meant to be contemplated for use by this invention. Once the location is known, the proper impedance setting for passive antenna elements may be performed. Such equivalents are intended to be encompassed in the scope of the claims.

What is claimed is:

1. A method for manufacturing a directive antenna, comprising:

providing a dielectric layer;

attaching at least one active antenna element and plural passive antenna elements to the dielectric layer; and electrically coupling at least a subset of the passive antenna elements to respective selectable impedance components independently selectable (a) to affect the phase of respective, re-radiated, link signals to be communicated between a first wireless unit and a second wireless unit by said at least one active antenna element to form a composite beam that may be positionally directed between the first wireless unit and second wireless unit and (b) according to an essentially optimal impedance setting as determined (i) from parameters of a received pilot signal transmitted from the first wireless unit or (ii) based on a signal quality metric of a signal transmitted by either the first wireless unit or second wireless unit.

2. The method according to claim 1 further comprising coupling a processor to the selectable impedance components, the processor configured to set a phase for each of the passive antenna elements via selection of the selectable impedance components such that upon transmission of reverse link signals from the second wireless unit, a directional reverse link signal beam is formed via said active and passive antenna elements to reduce emission in a direction of other receivers not intended to receive the reverse link signal.

3. The method according to claim 1 further including coupling a processor to the selectable impedance components, the processor configured to set an impedance of the selectable impedance components that (i) corresponds to an essentially optimal phase setting for each of the passive antenna elements and (ii) is set for each of the passive antenna elements such that a signal power to interference ratio is maximized.

4. The method according to claim 1 further including coupling a processor to the selectable impedance components, wherein the processor is configured to set an impedance of the selectable impedance components that (i) corresponds to an essentially optimal phase setting for each of the passive antenna elements and (ii) is set for each of the passive antenna elements such that a bit error rate is minimized.

5. The method according to claim 1 further including coupling a processor to the selectable impedance components, the processor configured to set the selectable impedance components to an essentially optimal phase setting for each of the passive antenna elements such that upon reception of a forward link signal at the second wireless unit, a directional receiving antenna is created from the active and passive antenna elements (i) to detect a forward link signal pattern sent from the direction of an intended transmitter, and (ii) to suppress detection of a signal pattern received from a direction other than the direction of the intended transmitter.

6. The method according to claim 1 wherein the selectable impedance components are independently selectable to affect the phase of respective forward link signals received at the second wireless unit at each of the antenna elements to provide rejection of signals that are received and that are not transmitted from the same direction as the first wireless unit which transmits the forward link signals intended for the second wireless unit.

7. The method according to claim 1 in which the manufactured directive antenna is used in a wireless communications system in which multiple second wireless units transmit code division multiple access signals on a common carrier frequency.

8. The method according to claim 7 wherein the code division multiple access signals are transmitted within a cell from among multiple cells in the system, each cell containing a first wireless unit and a plurality of second wireless units, each second wireless unit attached to a directive antenna.

9. The method according to claim 1 configured to be coupled to a system for providing wireless communications among a plurality of second wireless units using spread spectrum signaling for transmission of a plurality of desired traffic signals from the second wireless unit to the first wireless unit on a common carrier frequency within a defined transmission region.

10. The method according to claim 1 wherein at least one active antenna element is tuneable.

11. The method according to claim 10 wherein said at least one active antenna element is telescoping in length.

12. The method according to claim 10 wherein said at least one active antenna element is tuneable by adding extra width.

13. The method according to claim 1 wherein the passive antenna elements are tuneable beyond the selectable impedance.

14. The method according to claim 13 wherein the passive antenna elements are telescoping in length for tuning.

15. The method according to claim 13 wherein the passive antenna elements are tuneable by adding extra width.

16. The method according to claim 13 wherein said at least one active antenna element is tuneable.

17. The method according to claim 1 further including coupling at least one switch to the selectable impedance components.

18. The method according to claim 17 wherein the switch couples at least one impedance medium to the respective passive antenna element.

19. The method according to claim 18 wherein the impedance medium is a delay line.

20. The method according to claim 18 wherein the impedance medium is a lumped impedance.

21. The method according to claim 20 wherein the lumped impedance includes at least one of the following impedance components: a capacitor or an inductor.

22. The method according to claim 18 wherein the impedance medium includes a delay line and a lumped impedance.

23. The method according to claim 17 wherein the switch is a single-pole, double-throw switch.

24. The method according to claim 17 wherein the switch is a single-pole, multiple-throw switch.

25. The method according to claim 17 wherein the switch provides the impedance.

26. The method according to claim 1 wherein the selectable impedance components provide essentially infinite impedance granularity.

27. The method according to claim 26 wherein the selectable impedance components are varactors.

28. The method according to claim 1 wherein the dielectric layer is a circuit board with a single ground plane layer and further comprising mechanically attaching the passive antenna elements to the circuit board and (ii) electrically coupling the passive antenna elements to the ground plane layer via the respective selectable impedance components.

* * * * *

UNITED STATES PATENT AND TRADEMARK OFFICE

CERTIFICATE OF CORRECTION

PATENT NO. : 7,215,297 B2
APPLICATION NO. : 11/332901
DATED : May 8, 2007
INVENTOR(S) : Gothard et al.

It is certified that error appears in the above-identified patent and that said Letters Patent is hereby corrected as shown below:

IN THE DRAWINGS

At FIG. 11, item 1120, line 5, before the word "IMPEDANCE", delete "SLECTABLE" and insert therefor --SELECTABLE--.

IN THE SPECIFICATION

At column 1, line 31, before the word "Wireless", delete "an" and insert therefor --a--.

At column 6, line 38, after the word "units", delete "160" and insert therefor --60--.

At column 6, line 54, before the words "may be", delete "101" and insert therefor --60-1 through 60-3--.

At column 6, line 56, after the word "station", delete "104" and insert therefor --160--.

At column 6, line 67, after the word "base", delete "104" and insert therefor --station 160--.

At column 7, line 1, before the words "In a", delete "101", and insert therefor --60-1 through 60-3--.

At column 9, line 44, after "ence", delete "Io).", and insert therefor --$I_0$).--.

At column 9, line 66, after the word "shift", delete "setting" and insert therefor --settings--.

At column 10, line 19, after the word "more", delete "set" and insert therefor --sets--.

At column 10, line 43, after the word "step", delete "400" and insert therefor --401--.

At column 10, line 63, after the word "case", delete "Ec/Io" and insert therefor --$E_c/I_0$--.

At column 10, line 66, before the words "and fed", delete "I1" and insert therefor --$I_1$--.

At column 11, line 1, before the words "is fed", delete "m1" and insert therefor --M1--.

At column 11, line 12, after the word "letting", delete "w[2]" and insert therefor --W[2]--.

UNITED STATES PATENT AND TRADEMARK OFFICE

CERTIFICATE OF CORRECTION

PATENT NO. : 7,215,297 B2
APPLICATION NO. : 11/332901
DATED : May 8, 2007
INVENTOR(S) : Gothard et al.

It is certified that error appears in the above-identified patent and that said Letters Patent is hereby corrected as shown below:

At column 11, line 30, before the word “obtained” insert --is--.

At column 11, line 31, before the word “position”, insert --a--.

At column 11, line 33, after the word “directed”, delete “signals” and insert therefor --signal--.

At column 11, line 50, after the word “increase”, delete “is” and insert therefor --in--.

At column 11, line 64, after the word “factor”, delete “is” and insert therefor --in--.

At column 15, line 10, before the words “is used”, delete “Io ),” and insert therefor --$I_0$ ),--.

At column 15, line 38, after the word “impedance”, delete “components” and insert therefor --component--.

At column 15, line 58, after the word “magnitude”, delete “a part” and insert therefor --apart--.

At column 16, line 64, after the words “over the”, delete “central” and insert therefor --center--.

At column 17, line 8, after the word “selecting”, delete “of”.

At column 17, line 29, before the words “may be”, delete “701 706” and insert therefor --701-706--.

At column 17, line 38, after “1010”, delete “allows” and insert therefor --allow--.

At column 19, line 8, before the word “saves”, delete “1264” and insert therefor --1204--.

At column 20, line 8, before the words “is fed”, delete “Ec/Io” and insert therefor --$E_c/I_0$--.

At column 20, line 11, before the words “and fed”, delete “I1” and insert therefor --$I_1$--.

UNITED STATES PATENT AND TRADEMARK OFFICE

CERTIFICATE OF CORRECTION

PATENT NO. : 7,215,297 B2
APPLICATION NO. : 11/332901
DATED : May 8, 2007
INVENTOR(S) : Gothard et al.

It is certified that error appears in the above-identified patent and that said Letters Patent is hereby corrected as shown below:

At column 20, line 45, after the word "flow", delete "graph".

Signed and Sealed this

Thirteenth Day of November, 2007

JON W. DUDAS
*Director of the United States Patent and Trademark Office*